US007520371B2

(12) United States Patent
Lockledge et al.

(10) Patent No.: US 7,520,371 B2
(45) Date of Patent: Apr. 21, 2009

(54) MATERIALS AND PROCESSES FOR REDUCING COMBUSTION BY-PRODUCTS IN A LUBRICATION SYSTEM FOR AN INTERNAL COMBUSTION ENGINE

(75) Inventors: Scott P. Lockledge, Lafayette Hill, PA (US); Darrell W. Brownawell, Black Butte Ranch, OR (US)

(73) Assignee: Lutek, LLC, Wilmington, DE (US)

( * ) Notice: Subject to any disclaimer, the term of this patent is extended or adjusted under 35 U.S.C. 154(b) by 14 days.

(21) Appl. No.: 11/283,435

(22) Filed: Nov. 18, 2005

(65) Prior Publication Data

US 2006/0260874 A1 Nov. 23, 2006

Related U.S. Application Data

(63) Continuation-in-part of application No. 11/133,530, filed on May 20, 2005.

(51) Int. Cl.
*F16N 39/06* (2006.01)
*B01D 35/00* (2006.01)
*F01M 9/02* (2006.01)

(52) U.S. Cl. ..... 184/6.21; 184/6.24; 210/209; 123/196 A

(58) Field of Classification Search ..... 123/196 R, 123/196 A, 196 S; 210/206, 209, 167.02; 184/6.21, 6.24; 422/255, 256
See application file for complete search history.

(56) References Cited

U.S. PATENT DOCUMENTS

| | | | | |
|---|---|---|---|---|
| 2,316,080 | A | 4/1943 | Loane et al. | 252/48 |
| 2,617,049 | A | 11/1952 | Assef et al. | 260/503 |
| 2,647,889 | A | 8/1953 | Watson et al. | 260/139 |
| 2,835,688 | A | 5/1958 | Le Seur | 260/429.9 |

(Continued)

FOREIGN PATENT DOCUMENTS

EP 0331516 A1 * 3/1989

(Continued)

OTHER PUBLICATIONS

Mann, R. "Fluid Catalytic Cracking: Some Recent Developments in Catalyst Particle Design and Unit Hardware", *Catalysis Today*, 1993, 18, 509-528.

(Continued)

*Primary Examiner*—Michael Cuff
*Assistant Examiner*—Ka Chun Leung
(74) *Attorney, Agent, or Firm*—Woodcock Washburn LLP

(57) ABSTRACT

A lubrication system having an oil filter modified to replace or supplement the performance of lubricant additives that may be used within an internal combustion engine to increase the performance of a lubricant. The formulation of the lubricant is changed in accordance with the chemicals placed in the oil filter. For example, when the oil filter contains a strong base, the lubricant concentration of detergent will decrease, in some cases to zero, while the dispersant concentration in the lubricant will increase. The dispersant is the ideal weak base to neutralize combustion acid at the piston ring zone, carry the resultant weak base-combustion acid complex to the strong base in the oil filter, undergo ion exchange with the strong base, immobilize the acid in the oil filter and recycle back to the piston ring zone for reuse as an acid neutralization agent. The reduction or elimination of detergent from the lubricant will reduce the fouling of the emission filter and of deposit formation on engine parts such as the piston. The oil filter may also contain an additive which is slowly released into the lubricant. For example, a ZnDDP anti-wear additive may be slowly released from the oil filter to the lubricant. Because the ZnDDP has low molecular weight alkyl groups it has limited solubility in the lubricant. The rate of release is limited by the equilibrium concentration of the additive in the lubricant. As a result, a relatively constant concentration of the additive may be maintained in the lubricant. The resultant closed system allows the oil drain intervals to be significantly extended.

31 Claims, 23 Drawing Sheets

U.S. PATENT DOCUMENTS

| | | | | |
|---|---|---|---|---|
| 3,172,892 | A | 3/1965 | LeSeur et al. | 260/326.5 |
| 3,796,778 | A | 3/1974 | Gallacher | |
| 4,664,683 | A | 5/1987 | Degen et al. | 55/387 |
| 4,717,552 | A | 1/1988 | Carnell et al. | 423/230 |
| 4,828,698 | A | 5/1989 | Jewell et al. | 210/266 |
| 4,861,566 | A | 8/1989 | Denny | 423/230 |
| 4,865,826 | A | 9/1989 | Carnell et al. | 423/230 |
| 4,888,157 | A | 12/1989 | Carnell et al. | 423/230 |
| 4,894,210 | A | 1/1990 | Denny et al. | 423/230 |
| 4,906,389 | A | 3/1990 | Brownawell et al. | 252/25 |
| 4,946,660 | A | 8/1990 | Denny et al. | 423/230 |
| 4,977,871 | A | 12/1990 | Brownawell et al. | 123/196 |
| 4,978,439 | A | 12/1990 | Carnell et al. | 208/91 |
| 4,983,365 | A | 1/1991 | Denny et al. | 423/230 |
| 4,997,546 | A | 3/1991 | Shaub et al. | 208/183 |
| 5,019,311 | A | 5/1991 | Koslow | 264/122 |
| 5,042,617 | A | 8/1991 | Brownawell | 184/6.24 |
| 5,069,799 | A | 12/1991 | Brownawell et al. | 210/749 |
| 5,112,482 | A | 5/1992 | Shaub et al. | 210/209 |
| 5,147,722 | A | 9/1992 | Koslow | 428/402 |
| 5,189,092 | A | 2/1993 | Koslow | 524/495 |
| 5,225,081 | A | 7/1993 | Brownawell | 210/690 |
| 5,249,948 | A | 10/1993 | Koslow | 425/376.1 |
| 5,330,666 | A * | 7/1994 | Habeeb | 508/518 |
| 5,331,037 | A | 7/1994 | Koslow | 524/496 |
| 5,459,074 | A | 10/1995 | Muoni | 436/60 |
| 5,478,463 | A | 12/1995 | Brownawell et al. | 208/180 |
| 5,591,330 | A | 1/1997 | Lefebvre | 210/203 |
| 5,759,394 | A | 6/1998 | Rohrbach et al. | 210/264 |
| 5,792,513 | A | 8/1998 | Koslow et al. | 427/195 |
| 5,853,681 | A | 12/1998 | Denny et al. | 423/225 |
| 5,882,517 | A | 3/1999 | Chen et al. | 210/496 |
| 5,897,845 | A | 4/1999 | Denny et al. | 423/210 |
| 5,922,803 | A | 7/1999 | Koslow et al. | 524/496 |
| 5,928,588 | A | 7/1999 | Chen et al. | 264/113 |
| 6,007,706 | A | 12/1999 | Carnell et al. | 208/303 |
| 6,077,588 | A | 6/2000 | Koslow et al. | 428/114 |
| 6,103,116 | A | 8/2000 | Koslow et al. | 210/282 |
| 6,127,036 | A | 10/2000 | Xue et al. | 428/400 |
| 6,139,605 | A | 10/2000 | Carnell et al. | 95/164 |
| 6,221,241 | B1 | 4/2001 | Carnell et al. | 208/251 |
| 6,355,330 | B1 | 3/2002 | Koslow et al. | 428/114 |
| 6,379,564 | B1 | 4/2002 | Rohrbach et al. | 210/765 |
| 6,395,190 | B1 | 5/2002 | Koslow et al. | 210/767 |
| 6,485,813 | B1 | 11/2002 | Koslow | 428/198 |
| 6,505,597 | B2 | 1/2003 | Zulauf et al. | 123/196 |
| 6,550,622 | B2 | 4/2003 | Koslow | 210/490 |
| 6,623,636 | B2 | 9/2003 | Rohrbach et al. | 210/202 |
| 6,630,016 | B2 | 10/2003 | Koslow | 95/285 |
| 6,703,071 | B2 | 3/2004 | Koslow | 427/195 |
| 6,719,869 | B2 | 4/2004 | Koslow | 156/276 |
| 6,770,204 | B1 | 8/2004 | Koslow | 210/663 |
| 2002/0014447 | A1 | 2/2002 | Rohrbach et al. | 210/209 |
| 2002/0028166 | A1 | 3/2002 | Hendricks et al. | 423/210 |
| 2002/0053328 | A1 * | 5/2002 | Pudelski et al. | 123/90.33 |
| 2002/0195384 | A1 | 12/2002 | Rohrbach et al. | 210/266 |
| 2003/0089092 | A1 | 5/2003 | Bause et al. | 55/524 |
| 2003/0111398 | A1 | 6/2003 | Eilers et al. | 210/209 |
| 2004/0178142 | A1 | 9/2004 | Koslow | 210/500.29 |
| 2005/0040092 | A1 * | 2/2005 | Eilers et al. | 210/209 |
| 2006/0032814 | A1 | 2/2006 | Haberkamp et al. | 210/502.1 |

FOREIGN PATENT DOCUMENTS

| | | | |
|---|---|---|---|
| WO | WO 01/05583 | A1 | 1/2001 |
| WO | WO 01/92005 | A1 | 12/2001 |
| WO | WO 02/32548 | A1 | 4/2002 |
| WO | WO 02/083265 | A3 | 10/2002 |
| WO | WO 2004/065530 | A2 * | 8/2004 |

OTHER PUBLICATIONS

Mirrezaei-Roudaki, J., "Applications of Visualized Porosimetry for Pore Structure Characterisation of Adsorbents and Catalysts", The 1994 ICHEME Research Event, 565-567.

Paul A. Webb., "An Introduction to the Physical Characterization of Materials", Mercury Intrusion Porosimetry with Emphasis on Reduction and Presentation of Experimental Data, Jan. 2001, 1-22.

Webb, P.A. et al., "Analytical Methods in Fine Particle Technology", Micromeritics Instrument Corp:, Norcross, Georgia, 1997, 172-173.

Won, Y-Y. et al., "Effect of Temperature on Carbon-Black Agglomerates in Hydrocarbon Liquid with Adsorbed Dispersant", *Langmuir*, 2005, 21, 924-932.

* cited by examiner

Exhaust
243
Lubricant
Supply Line
232
234
242
Combustion
Zone
Piston
Rings
240
Piston
238
244
Filter
236
Piston
Cylinder
252
Oil
Fill
250
Pump
Lubricant
Return
248
246
230

$k_1$ = rate at which solid dissolves $k_2$ = rate at which dissolved material re-deposits or precipitates $k_3$ = rate at which additive is utilized, combusted, or degraded $K = \frac{k_1}{k_2}$ = equilibrium constant K is large for highly soluble materials (such as conventional ZDDP)

K is small for controlled release materials

| | |
|---|---|
| Manufacturer | Katalco<br>ICI |
| Commercial Name | Catalyst<br>75-1 |
| Material | ZnO |
| **Hg Intrusion Porosimetry Data** | |
| Total Intrusion Volume, ml/gm | 0.3 |
| Usable Pore Surface, $m^2$/gm (1066 to 60 Å) | 15-21 (Calculated values: *see* Background of the Invention section) |
| **Nitrogen Adsorption Data** | |
| BET Surface Area, $m^2$/gm | 80 (value disclosed in U.S. Patent No. 4,894,210) |

*FIG. 24*

| Manufacturer | Martin Marietta | Martin Marietta | U.S. Zinc | GH Chemicals |
|---|---|---|---|---|
| Commercial Name | Magchem P98, Dead Burned | Magchem 10, Hard Burned | AZO77HS A | CR-40 |
| Material | MgO | MgO | ZnO | ZnO |
| **Usable Surface Area** | | | | |
| BET Surface Area Reported By Manufacturer, $m^2$/gm | <0.1 | <10 | 9 | 5 |

*FIG. 25*

| Manufacturer | Iowa Limestone | Iowa Limestone | Franklin Industrial Minerals | Franklin Industrial Minerals | Great Lakes | Great Lakes |
|---|---|---|---|---|---|---|
| Commercial Name | Unical S | Unical F | C6 X 16 | C8 X 12 | 20 X 200 | 12 X 40 |
| Material | Limestone | Limestone | Limestone | Limestone | Limestone | Limestone |
| BET Surface Area Reported By Manufacturer, $m^2/gm$ | 0.42 | 0.038 | <0.5 | <0.5 | <0.5 | <0.5 |

*FIG. 26*

| Manufacturer | Martin Marietta | Martin Marietta | Martin Marietta | Martin Marietta | Premier Chemicals | Premier Chemicals | Premier Chemicals | Premier Chemicals | Bayer | Lanxess | Hydro Technologies |
|---|---|---|---|---|---|---|---|---|---|---|---|
| Commercial Name | Magchem 30 | Magchem 40 | Magchem 50 | Magchem HSA 30 | MagOx 98 LR | MagOx 98 HR | Premium | Super Premium | Zinkoxyd Akiv | ZnO Transparent | ZnO HT Active |
| Material | MgO | MgO | MgO | MgO | MgO | MgO | MgO | MgO | ZnO | $ZnCO^3$/ZnO/ MgO | ZnO |
| **Hg Intrusion Porosimetry Data** | | | | | | | | | | | |
| Total Intrusion Volume, ml/gm | 1.3 | 1.2 | 1.2 | 1.2 | 1.4 | 1.3 | 1.2 | 1.2 | 1.3 | 1.2 | 0.8 |
| Total Pore Area, $m^2$/gm | 33 | 59 | 75 | 160 | 49 | 79 | 105 | 130 | 44 | 53 | 61 |
| Median Pore Diameter, Å | 354 | 174 | 141 | 55 | 219 | 116 | 62 | 55 | 301 | 258 | 94 |
| Usable Pore Surface, $m^2$/gm (1066 to 80 Å) | 26 | 49 | 64 | 32 | 40 | 50 | 34 | 34 | 37 | 45 | 33 |
| Usable Pore Surface, $m^2$/gm (1066 to 60 Å) | 27 | 52 | 68 | 62 | 41 | 61 | 49 | 52 | 38 | 47 | 44 |
| **Nitrogen Adsorption Data** | | | | | | | | | | | |
| BET Surface Area, $m^2$/gm | 24 | 43 | 56 | 173 | 36 | 66 | 114 | 153 | 29 | 37 | 53 |
| BET Surface Area Reported By Manufacturer, $m^2$/gm | 20 to 30 | 45 | 65 | 160 | 40 | 65 | 110 | 150 | 45 | 45 | 40 |

*FIG. 27*

MATERIALS AND PROCESSES FOR REDUCING COMBUSTION BY-PRODUCTS IN A LUBRICATION SYSTEM FOR AN INTERNAL COMBUSTION ENGINE

CROSS-REFERENCE TO RELATED APPLICATIONS

The present patent application is a continuation-in-part patent application of U.S. patent application Ser. No. 11/133,530, and the subject matter of that patent application is hereby incorporated by reference in its entirety. The present application claims priority under 35 U.S.C. § 120 to that patent application.

FIELD OF THE INVENTION

The present invention relates to lubrication systems for use with internal combustion engines and, more particularly, to a lubrication system that reduces the formation of combustion by-products without reducing the performance of the lubricant in lubricating the internal combustion engine.

BACKGROUND OF THE INVENTION

During operation of an internal combustion engine, hydrocarbon fuel and oxygen burn in the presence of nitrogen. The fuel is converted principally into carbon dioxide and water, creating extremely high gas pressures that displace pistons and produce engine power. This combustion also results in the formation of contaminants that include organic, sulfur and nitrogen-based acids as well as soot formed from incomplete combustion. These contaminants cause undesirable engine wear, corrosion, increased oil viscosity and unwanted deposits when introduced into the lubricating oil through contact in the cylinder bore or through blow-by gases. Increases in corrosion, wear and viscosity degrade engine performance. Deposits on or near the pistons allow lubricant to pass the piston rings where it burns in the combustion chamber, generating a commensurate economic loss. Piston deposits also allow combustion gas to blow by piston rings, bringing additional acid and soot into the lubricant.

Lubricant additives, particularly detergents and dispersants, are used to combat these problems. Detergents are effective for controlling piston deposits; dispersants are effective for controlling viscosity increase due to soot and sludge formation; and both detergents and dispersants are effective for neutralizing combustion acid. However, these additives do have limitations. First, as detergents and dispersants neutralize combustion acids, they are stored in the engine lubricant as acid-base complexes or salts in the form of soluble or dispersible species. Solubility of these species limits the capacity of the lubricant to store such relatively polar products. If the upper solubility limits are surpassed, some of these polar by-products may precipitate, adhere to pistons, and form deposits. For example, Alan Schetelich and Pat Fetterman have reported in SAE Paper #861517 (October 6-9 International Fuel & Lubricants Meeting) that at a high detergent level in a diesel engine, up to 35% of the piston deposits were derived from the detergent. Clearly, increasing detergent concentration has diminishing returns. Second, high dispersant concentrations increase the viscosity of the lubricant, especially at low temperature, and high viscosities decrease lubricant and engine efficiency. While dispersants typically have higher solubility limits than detergents, they are more expensive. Thus, viscosity and economics limit how much dispersant can be added to the lubricant. Third, both detergents and dispersants are stoichiometric additives. Unlike a catalytically active material, each molecule performs its function one time and has a defined, limited capability.

As engine technology progresses toward greater cleanliness and efficiency, lubricants and additives face additional limitations. One such engine improvement, Exhaust Gas Recirculation (EGR), burdens the lubricant and additives with added levels of soot and acid, especially in diesel engines. While EGR decreases emission of undesirable species to the environment, it also operates at higher temperatures and, as a result, degrades the lubricant and additives more quickly. In a gasoline engine improvement, additional acid forms as combustion temperatures are increased in a quest for better fuel economy.

Further, certain components within the lubricant additives foul exhaust after-treatment systems and limit their effectiveness. These components—sulfated ash, phosphorus and sulfur (SAPS)—are introduced into these systems through the combustion of the lubricant. One such after-treatment system, a Diesel Particulate Filter (DPF), removes solids from diesel engine exhaust gas. These particulate filters capture fines and are regenerated by burning off trapped materials. However, non-combustibles (detergent and metallic anti-wear additives) from the lubricant accumulate over multiple cycles and foul the filter. Analytical procedures performed on the lubricant for SAPS accurately predict its potential to contribute to this fouling problem. Another exhaust gas after-treatment system removes nitrogen acids ($NO_x$) from diesel engines. Lubricant-derived SAPS partially poison this system and reduces its effectiveness.

Such after-treatment mechanisms are required to meet national emission limits and have specific performance requirements. For example, the United States Environmental Protection Agency mandates that all heavy-duty DPFs must operate for 150,000 miles before cleaning or replacement. As a result, limits on SAPS in commercial lubricants have been set by organizations that establish lubricant standards.

To avoid the problems outlined above, several additives must be reduced or replaced in a careful balance to maintain performance. For example, zinc dialkyldithio phosphate (ZnDDP) functions in two ways when used as a lubricant additive—as an anti-wear agent and as an antioxidant—and its concentration is determined by both roles. ZnDDP, however, also poisons emission catalysts through its phosphorus content. Therefore, any reduction in its concentration to avoid impacting exhaust after-treatment systems may require augmentation of either non-SAPS containing antioxidants or anti-wear agents. Other additives also serve as the source for lubricant-derived SAPS and may have to be reduced or eliminated to prevent after-system treatment fouling. For example, detergents contain sulfur and metals that give rise to sulfated ash.

Thus, while soot and acid derived from EGR and higher temperatures further contaminate the lubricant, other emission reduction technologies require a reduction in concentration of some additives intended to mitigate these by-products. Within the current paradigm of lubricant formulation, the only way to both reduce detergent level in the lubricant and adequately neutralize the increased amount of acid entering the lubricant is to decrease the oil drain interval. However, this approach has a severe economic penalty. Frequent oil drains are undesirable and have both direct and indirect consumer costs, as well as environmental impact. For each oil drain, consumers bear the direct costs of a new filter and lubricant, mechanic labor, and in the case of commercial trucks, lost delivery time. Consumers bear the indirect costs of filter and lubricant recycle or disposal. They also endure the negative environmental impact associated with the inappropriate disposal of used engine oil. Extended oil drain intervals instead conserve valuable resources. Since lubricant additive levels, in general, determine the oil drain interval, performance specifications pressure the lubricant industry to maintain upper limit concentrations of additive. In addition, they must also maintain backward compatibility to ensure that new formulations perform adequately in older engines.

Prior art patents to Brownawell et al. (U.S. Pat. Nos. 4,906,389, 5,068,044, 5,164,101 and 5,478,463) teach that immobilizing a strong base in an oil filter will reduce piston deposits, and pending U.S. patent application Ser. No. 11/133,530 teaches how to optimize the strong base for maximum acid retention capability. These disclosures represent one potential approach to deal with deposits, but if used with conventional lubricants, do not solve the broader issues outlined above. There is clearly a need for improved approaches to engine lubrication.

In light of the foregoing, there still remains a need for a lubrication system that significantly reduces the SAPS levels in a lubricant without negatively affecting engine performance. In particular, a lubrication system is desired that minimizes the use of SAPS-containing additives that combust to form contaminants which foul emissions after-treatment systems. The present invention addresses these needs in the art.

SUMMARY OF THE INVENTION

The invention encompasses a new engine lubrication paradigm for a gasoline or diesel internal combustion engine wherein the lubrication system, comprising a device such as a chemical oil filter, a specialized lubricant and/or a top-up-oil, work together as an integrated unit to maintain the performance of the engine and its accessories. In other words, the invention shifts the focus from the lubricant protecting the engine to a lubrication system comprising a chemical oil filter, a lubricant, and/or a top-up-oil. The lubrication system of the invention minimizes engine deposits, maintains efficient engine lubrication, enables effective emissions reductions, and prevents unnecessary economic penalties. The chemical filter immobilizes acid outside the engine, regenerates dispersant, enhances oxidation protection both in the oil filter and in the lubricant, and manages the concentration of phosphorus and sulfur containing anti-wear additive in the lubricant throughout the entire oil drain interval, among other roles. In cooperation with the chemical filter, the specially formulated lubricant maintains engine lubrication while enabling the proper functioning of the emission after-treatment system and the top-up-oil allows replacement of critical additives and oil that are consumed during engine operation. The formulation of the lubricant and top-up-oil may change based upon what materials are placed in the chemical oil filter.

The present invention includes internal combustion engine lubrication systems adapted to produce low levels of lubricant additive combustion by-products by using a specially formulated top-up-oil to replace additives lost such as when the lubrication system experiences a loss of lubricant volume over time during ordinary engine operation. The system comprises a device in liquid communication with the lubricant having means for supplementing or replacing functions of lubricant additives, a special lubricant having reduced levels of sulfated ash, phosphorus, and sulfur (SAPS), and a top-up-oil of a volume approximately equal to some volume of lubricant lost during operation, wherein the top-up-oil has substantially elevated amounts of one or more lubricant additives. The system of the invention enables at least one of the three SAPS levels to be reduced by at least 10% and as much as 90% below a conventional lubricant formulated to satisfy contemporary SAPS requirements while maintaining a high level of performance.

The lubricant system of the invention is integrated and the components are inter-related. For example, when the oil filter contains a strong base, the lubricant concentration of detergent may decrease, in some cases to zero. However, the dispersant concentration in the lubricant may remain the same or increase. The dispersant concentration is important since, as a suitable weak base, the dispersant neutralizes combustion acid at the piston ring zone and carries the resultant weak base-combustion acid complex to the strong base in the oil filter. There, it undergoes ion exchange with the strong base, it leaves the acid immobilized in the chemical oil filter, and it recycles back to the piston ring zone for reuse as an acid neutralization agent. Thus, quantities of strong base in the chemical oil filter and detergent concentration help determine dispersant concentration. The reduction or elimination of detergent from the lubricant will reduce the fouling of the emission after-treatment system via lowering SAPS and of deposit formation on engine parts such as the piston.

In another embodiment of the invention, the chemical oil filter may also contain additives that are slowly added to the lubricant in a controlled fashion. In one example, a ZnDDP anti-wear additive released from the oil filter supplements the lubricant. In one particular embodiment, low molecular weight alkyl or low solubility aryl groups on the ZnDDP limits its solubility in the lubricant. The solubility at equilibrium of this material limits the concentration of the additive in the lubricant. As a result, a constant concentration of the additive is maintained in the lubricant. In another embodiment, diffusion controls slow release of the additive into the lubricant. In yet another embodiment, the additive is metered into the lubricant.

Slow release of ZnDDP achieves this low constant concentration and, combined with an enhanced antioxidant capability, reduces the overall amount of this anti-wear/antioxidant additive required in the lubrication system and its contribution to SAPS. The metering, solubility, or diffusion controlled slow release rate of anti-wear additive in accordance with the invention accomplishes this objective.

It is well known that the ZnDDP additive functions as a powerful anti-oxidant as well as an anti-wear additive. Willermet has shown that when molecules of ZnDDP act as an anti-oxidant those molecules of ZnDDP could not also act in an anti-wear capacity. (P. A. Willermet, P. A. Mahoney and C. M. Haas, ASLF Trans 22 (1979) 301). Thus, soluble ash-less and/or immobilized anti-oxidants may extend the effectiveness of ZnDDP. In an embodiment of the invention, an immobilized hydroperoxide decomposer and/or radical scavenger may be incorporated in the oil filter. Suitable hydroperoxide decomposers that can be immobilized in the oil filter are taught in the aforementioned Brownawell et al. patents (U.S. Pat. Nos. 4,997,546, 5,112,482, and 5,209,839). The incorporation of the hydroperoxide decomposer in the oil filter allows a higher than normal percentage of ZnDDP molecules to act in an anti-wear capacity and thus allows a further decrease in the ZnDDP concentration in the lubricant. In another embodiment, the lubricant may also contain an enhanced concentration of soluble anti-oxidants, especially ash-less anti-oxidants.

In conventional lubrication systems, the ZnDDP decomposes at a relatively high rate. Sufficient ZnDDP must be present in the initial charge of lubricant to extend the anti-wear activity for the entire oil drain interval. The high level of phosphorus in the fresh oil presents a surge of phosphorus poisoning to any phosphorus sensitive catalyst. It would be beneficial if the phosphorus level were constant at a lower concentration throughout the oil drain level. Accordingly, an embodiment of the invention uses a lubricant containing a lower than normal concentration of ZnDDP or even no ZnDDP.

The formulation of a top-up-oil will change in tandem with the formulation of the lubricant. The object of the formulation of the top-up-oil is to extend the oil drain interval by replacing the additives in the lubricant that are consumed. It is recognized that different additives in the lubricant are consumed at different rates and thus the top-up-oil may have a different composition than the lubricant. It is also recognized that often top-up-oil is added when 10% of the lubricant has been consumed. Thus, to bring the concentration of the various additives back to approximate the fresh lubricant charge means that there is a different ratio of additives in the top-up-oil than in the lubricant. The dispersant is recycled and only slowly consumed, e.g. by dispersing soot and sludge or by oxidative degradation; the ashless anti-oxidant is consumed in performing its function; the viscosity modifier is degraded in function at different rates depending on whether or not a shear stable viscosity modifier was used. Thus, in most cases the top-up-oil is not formulated to be a lubricant but to supplement the lubricant. However, in some cases it may be economical, e.g., for ease of storage and use, for the top-up-oil to have the same composition as the lubricant.

Embodiments of the invention relate to internal combustion engine lubrication systems adapted to produce low levels of lubricant additive combustion by-products by providing a lubrication system that lowers the SAPS levels below the SAPS level that would otherwise be possible for a given lubricant formulation without the aid of a chemical oil filter. Such reduced SAPS levels may be at least 10% and as much as 90% below the SAPS levels of a conventional lubricant formulated to satisfy contemporary SAPS requirements at a high level of performance. The system includes a device that is in liquid communication with the lubricant and that supplements or replaces the function of the lubricant additive. In an exemplary embodiment, the device includes a material, such as a strong base or anti-oxidant, which can be a matrix combined with a chemical, adapted to supplement or replace a function of a lubricant additive so as to reduce the need for the lubricant additive in the lubricant.

In another aspect, the present invention provides an internal combustion engine lubrication system adapted to produce low levels of lubricant additive combustion by-products comprising a lubricant having reduced levels of a lubricant additive relative to a level of the lubricant additive corresponding to a given maximum SAPS level and a device that is in fluid contact with the lubricant and slowly releases at least one lubricant additive into the lubricant. The device can be a chemical filter or a metering device. The lubricant additive can be selected from an anti-wear agent, detergent, extreme pressure additive, friction modifier, antioxidant, organic acid neutralizing agent, dispersant, viscosity index improver, pour point depressant, flow improver, anti-foaming agent, anti-misting agent, cloud-point depressant, or a corrosion inhibitor, or a combination thereof. The lubrication system so configured maintains reduced SAPS levels that may be at least 10% and as much as 64% below the SAPS levels of a conventional lubricant at a high level of performance but without the system of the invention.

Other aspects of the present invention include an internal combustion engine lubrication system adapted to produce low levels of lubricant additive combustion by-products, comprising a lubricant having reduced levels of a lubricant additive relative to a level of the lubricant additive corresponding to a given maximum SAPS level, and a device that is in fluid contact with the lubricant, the device having immobilized thereto a chemical species capable of supplementing or replacing the function of an additive that interacts with the combustion by-products. The device in combination with such a lubricant enables reduced SAPS levels that may be at least 10% and as much as 70% below the SAPS levels of a conventional lubricant at a high level of performance but without the device of the invention.

In further aspects, the present invention provides an internal combustion engine lubrication system adapted to produce low levels of lubricant additive combustion by-products, comprising a device having a strong base immobilized thereto, and a lubricant having reduced levels of detergent relative to a level of detergent in a lubricant formulated to perform to an equivalent high level without said device.

In other aspects, the present invention provides an internal combustion engine lubrication system adapted to produce low levels of lubricant additive combustion by-products, comprising a device having an anti-oxidant immobilized thereto, and a lubricant having reduced levels of ZnDDP relative to a level of ZnDDP in a lubricant formulated to perform to an equivalent high level without said device.

Some aspects of the present invention include an internal combustion engine lubrication system adapted to produce low levels of lubricant additive combustion by-products, comprising a device capable of slowly releasing an anti-wear agent into a lubricant, and the lubricant having reduced levels of anti-wear agent relative to a level of the anti-wear agent in a lubricant formulated to perform to an equivalent high level without said device.

In other aspects, the present invention provides an internal combustion engine lubrication system adapted to produce low levels of lubricant additive combustion by-products, comprising a device capable of slowly releasing a friction modifier into a lubricant, and the lubricant having reduced levels of a friction modifier relative to a level of the friction modifier in a lubricant formulated to perform to an equivalent high level without said device.

In still other aspects, the present invention provides an internal combustion engine lubrication system adapted to produce low levels of lubricant additive combustion by-products, comprising a lubricant having lubricant additives that produce a sulfated ash content at or below about 0.9 wt % and/or a phosphorus content at or below about 0.1 wt %, and a device that is in fluid contact with the lubricant and interacting with the lubricant so as to perform or supplement at least one function of lubricant additives.

The present invention further provides an internal combustion engine lubrication system adapted to produce low levels of lubricant additive combustion by-products comprising a lubricant having lubricant additives that produce a sulfated ash content at or below about 0.9 wt % and/or a phosphorus content at or below about 0.1 wt %, and a device that is in fluid contact with the lubricant, the device having immobilized thereto a chemical species capable of supplementing or replacing the function of an additive that interacts with the combustion by-products.

The invention further includes a device for use within an internal combustion engine lubrication system, the device being in fluid contact with a lubricant and comprising a filtration media (or porous support) having a lubricant additive contained therein, wherein the lubricant additive is slowly released into the lubricant over an extended time by controlling the equilibrium solubility of the lubricant additive.

Other aspects of the invention provide a method of lubricating an internal combustion engine, comprising providing a lubricant circulating within a lubrication system that is in fluid contact with portions of the internal combustion engine requiring lubrication, and providing a device in fluid contact with the lubricant that performs or supplements a function of a lubricant additive, wherein the lubricant has reduced levels of the lubricant additive relative to a level of the lubricant additive corresponding to a given maximum SAPS level.

These and various other features of novelty, and their respective advantages, are pointed out with particularity in the claims annexed hereto and forming a part hereof. However, for a better understanding of aspects of the invention, reference should be made to the drawings which form a further part hereof, and to the accompanying descriptive matter, in which there is illustrated preferred embodiments.

BRIEF DESCRIPTION OF THE DRAWINGS

FIG. 24 is a table of porosity characteristics associated with strong base material Catalyst 75-1.

FIG. 25 is a table of porosity characteristics of additional strong base materials.

FIG. 26 is a second table of porosity characteristics of additional strong base materials.

FIG. 27 is a third table of porosity characteristics of candidate strong base materials.

DETAILED DESCRIPTION OF ILLUSTRATIVE EMBODIMENTS

Figure 1:
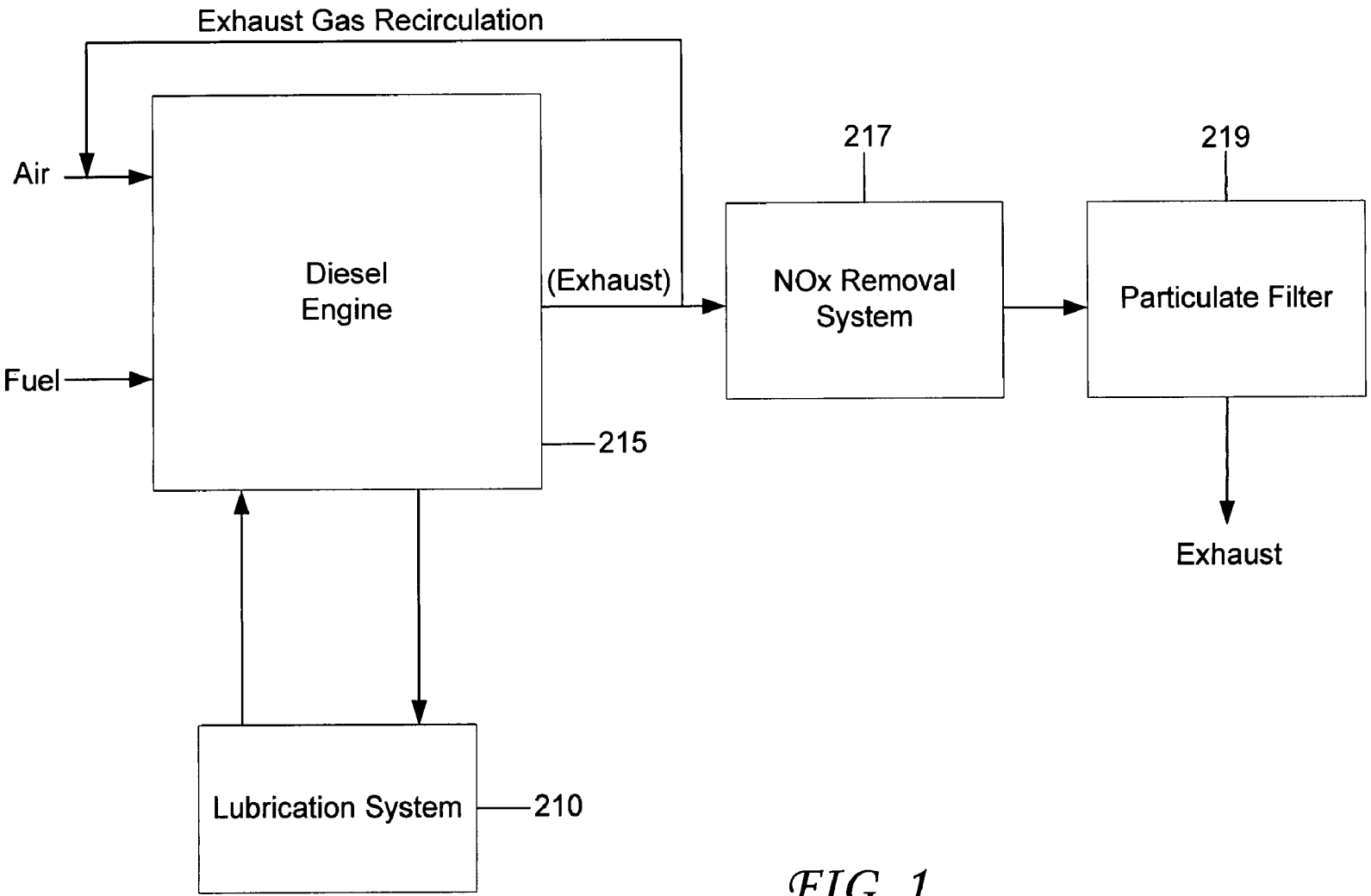
FIG. 1 is a schematic of one embodiment of the lubrication system of the invention for use with a diesel engine.

The present invention may be understood more readily by reference to the following detailed description of illustrative and preferred embodiments taken in connection with the accompanying FIGS. 1-27 that form a part of this disclosure. It is to be understood that the scope of the claims is not limited to the specific devices, methods, conditions or parameters described and/or shown herein, and that the terminology used herein is for the purpose of describing particular embodiments by way of example only and is not intended to be limiting of the claimed invention. Also, as used in the specification including the appended claims, the singular forms "a," "an," and "the" include the plural, and reference to a particular numerical value includes at least that particular value, unless the context clearly dictates otherwise. When a range of values is expressed, another embodiment includes from the one particular value and/or to the other particular value. Similarly, when values are expressed as approximations, by use of the antecedent "about," it will be understood that the particular value forms another embodiment. All ranges are inclusive and combinable.

Definitions

As used herein, the term "anti-oxidant" refers to a hydroperoxide decomposition agent or radical scavenger, or a combination thereof.

As used herein, the term "anti-wear agent" refers to a chemical that is designed to reduce wear between sliding metal surfaces.

As used herein the term "chemical filter" means a filter that interacts with a lubricant to chemically enhance or supplement additives in the lubricant. In one example, the chemical filter can be a porous support media employing a strong base material capable of displacing a weak base from a combustion acid-weak base complex that comes into contact with the strong base material. In another embodiment, the chemical filter may be a conventional filter that is chemically enhanced or modified to provide a way to introduce lubricant additives into the lubricant using the techniques of the invention.

As used herein "chemically enhancing or supplementing the additives in a lubricant" results in enhancing the performance of the lubricant which, in turn, results in decreased piston deposits, or increasing the oil drain interval as measured by TBN or decreasing SAPS with decreased detrimental impact on emission after treatment devices.

As used herein, the term "control of solubility" refers to a mechanism such as a low level of solubility of a lubricant additive in a lubricant that acts to control the rate at which a lubricant additive passes from a state separate from the lubricant to being soluble in the lubricant.

As used herein, the term "control rate of diffusion" refers to a controlled rate or diffusion or movement of a chemical, usually an active chemical, through another chemical, usually an inert chemical with the rate of diffusion being suitable for the application.

As used herein, the term "control rate of metering" refers to the rate at which an additive is released to enter a lubricant by a metering mechanism such as a pump.

As used herein, the term "corrosion inhibitor" refers to a chemical that reduces corrosion of a surface, e.g., acidic attack on a metallic surface.

As used herein, the term "dispersant" refers to a chemical that disperses soot and/or sludge and neutralizes acidic chemicals.

As used herein, the term "extreme pressure additive" refers to a chemical that is designed to reduce wear between metal surfaces coming into contact often at a high pressure.

As used herein, the term "flow improver" refers to a chemical that alters the flow characteristics of liquid.

As used herein, the term "friction modifier" refers to a chemical that alters the lubricity of a surface.

As used herein, the term "function of a lubricant additive" refers to at least one engine protective role exhibited by a lubricant additive. The following represent categories of lubricant additives according to function or engine protective role: detergent, which acts to (remove or) neutralize combustion acids; anti-oxidants, which act to (remove or) neutralize peroxides and/or free radicals; anti-wear, which protects surfaces of engine parts; and viscosity modifier, which modifies the high and low temperature viscosity of a lubricant. In the present invention, chemicals existing outside of the lubricant itself, for example, residing in a chemical filter, can in some instances supplement and in other cases replace the function of lubricant: additives and in still other cases release additives for functioning within the lubricant.

As used herein, the term "lifecycle" refers to lubricant use, expressed in units such as engine hours or vehicle miles, before the lubricant needs to be replaced, usually indicated by the lubricant reaching a critical TBN.

As used herein, the term "lifecycle of an after treatment device" refers to the useable life of an after treatment device usually measured in terms of miles of engine use before it becomes necessary to clean, revitalize or replace the after treatment device.

As used herein, the term "lubrication system" or "internal combustion engine lubrication system" refers to a substantially closed system in which a lubricant circulates throughout. The lubrication system is in fluid contact with a combustion engine so that, as the lubricant circulates through the lubrication system, at some segments of the lubrication system the lubricant contacts the internal combustion engine, including the surfaces of the piston and piston chamber.

As used herein, the term "maximum SAPS" or "maximum SAPS level" refers to total concentrations of sulfated ash, phosphorus, and sulfur present in oil, in units such as parts per million or weight percent. Certain lubricant additives, e.g., ZnDDP, contribute to each one, or even all, of the sulfated ash, phosphorus, and sulfur levels. The maximum levels are the maximum levels of sulfated ash, phosphorus, and sulfur allowed in the lubricant according to a lubricant standard designating body. A "lubricant standard designating body" is used herein to refer to an oil or lubricant standards group such as the American Petroleum Institute ("API") or International Lubricant Standardization and Approval Committee ("ILSAC"). The API, at 1220 L Street, Northwest, Washington, D.C. 20005 (http://www.api.org), licenses marketers of engine oil around the world the use of the API Service Symbol and the API Certification Mark. Engine oils displaying these marks are required to meet minimum performance standards as demonstrated by engine and bench tests. For passenger car oils, the latest API service category is SM. The latest heavy-duty service category is CI-4 Plus. In addition, oils that demonstrate fuel economy benefits may be designated Energy Conserving. ILSAC standards are a cooperative effort of the American Automobile Manufacturers Association (AAMA), at 7430 Second Avenue, Suite 300, Detroit, Mich. 48202 (http://www.aama.com), and the Japan Automobile Manufacturers Association, Inc. (JAMA), at Otemachi Building 6-1, Otemachi 1-chome, Chiyoda-ku, Tokyo 100, Japan. ILSAC's 'Starburst' Certification Mark indicates that an oil has met the current Minimum Performance Standard for Passenger Car Engine Oils issued by ILSAC. The GF-4 standard corresponds to the API SM category. In Europe, the equivalent standardization organization is Association des Constructeurs Européens de l'Automobile (ACEA) and is located at Rue du Noyer 211, B-1000 Brussels, Belgium.

The following Table 1 illustrates current levels of SAPS.

TABLE 1

Current Commercial Diesel and Gasoline Lubricants

| Lubricant Brand Name | Valvoline Premium Blue | Castrol Tection Extra | Mack Bulldog EO-N Premium Plus | Chevron Delo 400 | Shell Rotella T | Mobil Mobil One | Pennzoil Advanced Protection | Valvoline Motor Oil | Exxon Superflo | Castrol GTX |
|---|---|---|---|---|---|---|---|---|---|---|
| Certification | CI-4 Plus | CI-4 Plus | CI-4 | CI-4 Plus | CI-4 Plus | SM, GF-4 | SM, GF-4 | SM, GF-4 | SM, GF-4 | SM, GF-4 |
| Grade | 15 W-40 | 15 W-40 | 15 W-40 | 15 W-40 | 15 W-40 | 10 W-30 | 10 W-30 | 10 W-30 | 10 W-30 | 10 W-30 |
| Engine | Diesel | Diesel | Diesel | Diesel | Diesel | Gasoline | Gasoline | Gasoline | Gasoline | Gasoline |
| Ca (ppm)[1] | 3896 | 2749 | 3647 | 3435 | 3585 | 2502 | 1873 | 2003 | 1965 | 2167 |
| Mg (ppm)[1] | 12 | 115 | 12 | 10 | 13 | 14 | 6 | 8 | 9 | 10 |
| P (ppm)[1] | 1475 | 1163 | 1331 | 1330 | 1248 | 743 | 771 | 750 | 792 | 787 |
| Zn (ppm)[1] | 1649 | 1271 | 1488 | 1493 | 1372 | 821 | 873 | 814 | 856 | 856 |

TABLE 1-continued

Current Commercial Diesel and Gasoline Lubricants

| Lubricant Brand Name | Valvoline Premium Blue | Castrol Tection Extra | Mack Bulldog EO-N Premium Plus | Chevron Delo 400 | Shell Rotella T | Mobil Mobil One | Pennzoil Advanced Protection | Valvoline Motor Oil | Exxon Superflo | Castrol GTX |
|---|---|---|---|---|---|---|---|---|---|---|
| S (ppm)[1] | 4543 | 4060 | 4500 | 4253 | 4829 | 1911 | 2220 | 2536 | 4507 | 2648 |
| Sulfate Ash (wt. %)[2] | 1.63 | 1.20 | 1.53 | 1.45 | 1.46 | 1.00 | 0.82 | 0.84 | 0.82 | 0.88 |

[1]= test Method D5185
[2]= Test Method D874

As used herein, the term "neutralizing agent" refers to a basic chemical that neutralizes acidic chemicals.

As used herein, the term "oil filter," "standard oil filter," or "traditional oil filter" refers to an oil filter that is commonly used by most trucks in which particulates are removed from a lubrication system normally by size exclusion.

As used herein, the term "pour point depressant" refers to a chemical that lowers the pour point of a liquid.

As used herein, the term "strong base" refers to a basic material that is capable of displacing a weaker base, e.g., a dispersant, from a weak base-combustion acid complex and immobilizing the combustion acid with the strong base.

As used herein, the term "top-up-oil" refers to a small quantity of fresh oil that supplements combustion engine lubricant lost during the operation of the combustion engine, which may or may not comprise substantially elevated amounts of at least one lubricant additive.

As used herein, the term "ZnDDP" refers to zinc dialkyl dithiophosphate or zinc diaryl dithiophosphate.

As used herein, the terms "0W-XX, 5W-XX, or 10W-XX" refer to multigrade lubricants.

Overview

The need to reduce diesel particulate and combustion acids in the emissions from internal combustion engines for health reasons has led to proposed new diesel emission regulations. Most diesel engine manufacturers have decided that the most efficient way they can meet these proposed regulations is to attach after-treatment devices to the emission stream. A filter will trap particulates, primarily soot particulates. A catalyst will decompose nitrogen acids. Mandated limits on sulfur in the fuel and lubricant will reduce sulfur based acids. The filter will periodically cycle to a burn mode to convert the soot particles to carbon dioxide and water. Another source of particulates derives from lubricant burned in the combustion chamber. The two largest sources of these particulates are metal containing detergents and ZnDDP anti-wear additives. The third source is wear debris. The phosphorus from the anti-wear additive also acts to poison the nitrogen acid removal catalyst. In order to extend the lifecycle of the emission filter and the nitrogen acid catalyst, limits are being proposed on sulfated ash, phosphorus and sulfur (SAPS). The system of this invention provides a solution that allows the functionality of the lubricants to be maintained while satisfying ever lower SAPS concentrations.

The present invention relates to a lubrication system for the improvement in lubricant protection of an internal combustion engine and the operation of its attendant emission control equipment, or after-treatment devices. The lubrication system comprises a lubricant having reduced levels of lubricant additive relative to at least one of the three SAPS levels and significantly below, at least 10% and as much as 90% below, the SAPS level of a lubricant formulated to an equivalent high level of performance but without the use of a chemical filter, and a device in liquid communication with the lubricant having means for performing or supplementing a function of the lubricant additive. The lubricant is in fluid contact with the device and the internal combustion engine, as the lubricant is in fluid flow throughout the lubrication system. In some embodiments, the device can have associated to itself a particle, which can be a chemical or a matrix combined with a chemical, having the means for performing or supplementing functions of lubricant additives.

Heretofore, the lubricant protection of the engine, i.e., control of corrosion, piston deposits, wear, sludge, etc. has been the function of the lubricant that includes lubricant additives in its formulation. An oil filter, via size exclusion, removes abrasive particles from the lubricant. Emission control equipment reduces and controls the deleterious effects of combustion emissions. However, the effect of the lubricant additive on the life of the emission control equipment must be considered. In this invention, several engine protective functions from the lubricant additives are performed or supplemented by a device incorporated into the lubrication system, e.g., a chemical filter and/or a metering device. In some examples, a strong base resides in the chemical filter to supplement the activity of a detergent/dispersant in the lubricant is described in several patents, U.S. Pat. Nos. 4,906,389, 5,068,044, 5,069,799, 5,164,101 and U.S. patent application Ser. No. 11/133,530, which are incorporated herein in their entirety.

In most lubrication systems, the lubrication system experiences a loss of a volume of lubricant over time during the ordinary course of operation of the combustion engine. The lubrication system of the invention thus further comprises a top-up-oil of a volume approximately equal to the volume of lubricant lost during operation, wherein the top-up-oil has substantially elevated amounts of some lubricant additives.

The functions of a lubricant additive performed or supplemented by the device can include a strong base, anti-oxidant, anti-wear agent, extreme pressure additive, acid neutralizing agent, corrosion inhibitor, or a combination thereof. In some embodiments, the device will have incorporated to itself a strong base, detergent, anti-oxidant, anti-wear agent, extreme pressure additive, organic acid neutralizing agent, dispersant, friction modifier, viscosity index improver, pour point depressant, flow improver, anti-foaming agent, anti-misting agent, cloud-point depressant, or a corrosion inhibitor, or a compound having similar engine protecting properties. For example, a strong base can be associated to a device such as a chemical filter and the resulting device will supplement an engine protecting property like that of a dispersant in the lubricant. In some embodiments, a lubricant additive is associated with the device and is slowly released into the lubricant, thereby allowing for reduced concentrations in the lubricant.

Anti-oxidants can be, for example, a hydroperoxide decomposition agent or radical scavenger, or a combination thereof. The hydroperoxide decomposition agent is preferably ZnDDP. In some embodiments, the anti-oxidant can be selected from MoS compounds, $MoS_2$ compounds, $Mo_4S_4(C_8H_{17}OCS_2)_6$ compounds, hindered phenols, aromatic amines, divalent sulfur, disulfides, phosphates, trivalent phosphorus, phosphates, hydroquinones, dihydroquinolines, metal deactivators, or NaOH, or a combination thereof.

Anti-wear agents can be, for example, ZnDDP, fatty esters, dithiophosphates, dithiocarbonates, thiocarbamates (including thiocarbamate esters, thiocarbamate amides, thiocarbamate ethers, alkene-coupled thiocarbamates), or bis(S-alkyldithiocarbamyl)sulfides.

Extreme pressure additives can be selected from sulfurized fats, sulfurized fatty esters, sulfurized olefins, sulfurized polyolefins, disulfides, dialkyl disulfides, tributyl phosphate, tricresylphosphate, phosphates, phosphonates, phosphoric esters, phosphorized fats, ZnDDP, amine dithiophosphates, phosphorized olefins, or phosphor-sulfurized olefins, or a combination thereof.

An acid neutralizing agent can be one of the following: oil-soluble amines, oil-soluble amine salts, dispersants, trialkyl amines, trioctadecyl amine, or tetraoctadecyl ammonium hydroxide, or a combination thereof.

The corrosion inhibitor can include ZnDDP, imidazolines, alkyl pyridines, ethoxylated phenols, phosphate esters, or phosphonate esters, thiodiazole, benzotriazole, or a combination thereof.

System Description

The lubrication system of the invention is characterized by a specially formulated lubricant, a specially formulated top-up-oil, and a device that supplements or replaces the functions of certain lubricant additives so as to produce low levels of lubricant additive combustion by-products. Each of these elements of the invention will be described in turn below.

Devices for Supplementing or Replacing Functions of Lubricant Additives Slow Release Device An exemplary embodiment of the present invention provides an internal combustion engine lubrication system adapted to produce low levels of lubricant additive combustion by-products, comprising a lubricant having at least one of the three SAPS levels significantly below, at least 10% and as much as 100% below, the SAPS levels of a lubricant formulated to an equivalent high level of performance but without the use of the previously mentioned device, e.g., chemical filter; and a device that is in fluid contact with the lubricant and slowly releases at least one lubricant additive into the lubricant. The device can be a chemical filter and/or a metering device. The lubricant additive can be selected from a detergent, anti-oxidant, anti-wear agent, extreme pressure additive, organic acid neutralizing agent, dispersant, friction modifier, viscosity index improver, pour point depressant, flow improver, anti-foaming agent, anti-misting agent, cloud-point depressant, or a corrosion inhibitor, or a combination thereof.

The slow release of the lubricant additive may be accomplished by modifying the solubility of the lubricant additive with respect to the lubricant. The modification can be the reduction in number of methylene units of the alkyl chains that exist in the lubricant additives—typically, the alkyl chains enhance the solubility of the lubricant additive. For example, a commonly used lubricant additive, zinc dialkyl dithiophosphate (ZnDDP), has four alkyl moieties—two alkyl moieties per thiophosphate group. The alkyl moieties are necessary to enhance the solubility of ZnDDP. By reducing the length of the alkyl chains, or the number of methylene units, the solubility of ZnDDP will be much reduced. However, the modification can also be achieved by substitution of the alkyl chain with aryl or other chemical moieties that impart to the additive a desired solubility level in the lubricant. The objective is to ensure that the solubility of the active species in the lubricant is high enough to perform its function adequately (e.g. for ZnDDP, form a protective film), but not so high as to allow an excessive concentration that would contribute to SAPS levels and/or subject the solubilized additive to thermal and/or oxidative degradation. For example, Palacios has shown that ZnDDPs may form films up to about 40 $ug/cm^2$ thick although full anti-wear protection is achieved by a reaction film thickness of only about 15 $ug/cm^2$. Film thickness is directly related to ZnDDP concentration (J. M. Palacios, Wear 114 (1987) 577). Other mechanisms or methods to control the additive solubility and therefore the rate at which these species enter the lubricant are possible and envisioned. For example, two or more additives may be gelled to control their solubility as outlined in US patent applications 2005/0085399 and 2005/0137097. Alternatively, additives may be incorporated into materials which slowly dissolve and release additives into the lubricant, such as thermoplastic polymers, as outlined in U.S. Pat. No. 4,075,098.

The slow release may also be accomplished using a filtration media (or porous support) having a lubricant additive contained within, wherein the lubricant additive is slowly released into the lubricant over an extended time by controlling the solubility of the lubricant additive.

Immobilized Device

Other exemplary embodiments of the invention include an internal combustion engine lubrication system adapted to produce low levels of lubricant additive combustion by-products, comprising a lubricant having at least one of the three SAPS levels significantly below, at least 10% and as much as 90% below, the SAPS level of a lubricant formulated to an equivalent high level of performance but without the use of the previously mentioned device, e.g., chemical filter, and a device that is in fluid contact with the lubricant, the device having immobilized thereto a chemical species capable of performing the function of an additive that interacts with the combustion by-products. One chemical species supplementing the function of a lubricant additive includes a strong base and another chemical species performing the function of a lubricant additive includes an anti-oxidant immobilized thereto.

Hydroperoxide Remover Chemical Filter

A number of hydroperoxide decomposers can be used to remove hydroperoxides from a lubricating oil. Some hydroperoxide decomposers that can be incorporated into the device of the present invention include $MoS_2$, $Mo_4S_4(ROCS_2)_6$, NaOH, or mixtures thereof. $Mo_4S_4(ROCS_2)_6$, NaOH, or mixtures thereof are preferred. In some embodiments, NaOH is a preferred hydroperoxide remover.

As disclosed in related application, U.S. Pat. No. 4,997,546, $Mo_4S_4(ROCS_2)_6$ is formed by reacting molybdenum hexacarbonyl, $Mo(CO)_6$, with a dixanthogen, $(ROCS_2)_2$. The reaction is conducted at temperatures ranging from about ambient conditions (e.g., room temperature) to about 140° C., especially between about 80° C. to about 120° C., for from about 2 to about 10 hours. For example, the $Mo(CO)_6$ and the dixanthogen may be refluxed in toluene for times ranging from about 2 to about 8 hours. The reaction time and temperature will depend upon the dixanthogen selected and the solvent used in the reaction. However, the reaction should be conducted for a period of time sufficient to form the compound. Solvents that are useful in the reaction include aromatic hydrocarbons, especially toluene.

Dixanthogens that are especially useful can be represented by the formula $(ROCS_2)_2$ in which R can be the same or different organo groups selected from alkyl, aryl, and alkoxyalkyl groups having a sufficient number of carbon atoms such that the compound formed is soluble in a lubricating oil. Preferably R will have from 2 to 20 carbon atoms. More preferably, R will be an alkyl group having from 2 to 20 carbon atoms, especially from 4 to 12 carbon atoms.

In forming $Mo_4S_4(ROCS_2)_6$, the mole ratio of dixanthogen to molybdenum hexacarbonyl should be greater than about 1.5 to 1.0. For example, in preparing this compound, mole ratios of $(ROCS_2)_2$ to $Mo(CO)_6$ in the range of from about 1.6:1 to about 2:1 are preferred.

Depending primarily upon the time and temperature at which the $Mo(CO)_6$ and $(ROCS_2)_2$ are reacted, the molybdenum and sulfur containing additive that forms is a brown compound, a purple compound, or a mixture of both. Shorter reaction times (e.g., four hours or less) favor the formation of the purple compound. Longer reaction times (e.g., four hours or more) favor formation of the brown compound. For example, when $(C_8H_{17}OCS_2)_2$ is reacted with $Mo(CO)_6$ in toluene for four hours at 100° C. to 110° C., most of the starting material is converted to the purple compound, with virtually none of the brown compound being present. However, continued heating of the reaction mixture results in conversion of the purple compound to the brown compound. Indeed, after about six or seven hours, the purple form is largely converted to the brown form.

The $Mo(CO)_6$ and dixanthogen can be contacted for a period of time sufficient for reaction to occur, but typically less than about 7 hours. Beyond 7 hours, undesirable solids begin to form. To maximize the formation of the compound and minimize the formation of undesirably solid by-products, the $Mo(CO)_6$ should be reacted with the dixanthogen at temperatures of about 100° C. to about 120° C. for times ranging from about five to six hours, thereby producing reaction mixtures which contain both the brown and purple forms of the compounds. This is not a disadvantage because both forms are effective additives, and mixtures of the two species (brown and purple) perform as well as either species alone.

The compounds formed with R groups between about $C_4H_9$ and about $C_{14}H_{29}$ can be readily separated from oily organic by-products of the reaction by extracting the oily by-products with moderately polar solvents such as acetone, ethyl alcohol, or isopropyl alcohol. The compounds with these R groups are substantially insoluble in such solvents, while the oily by-products are soluble. Separation of the compounds from the by-products, however, is not necessary because the by-products do not detract from the beneficial functional properties of the compounds.

The physical properties of the purple and brown forms vary with the R group. For example, the compound is a crystalline solid when R is $C_2H_5$ and an amorphous solid when R is larger than about $C_7H_{15}$.

The purple compound formed in reacting $Mo(CO_6)$ with $(ROCS_2)_2$ is a thiocubane of the formula $Mo_4S_4(ROCS_2)_6$.

The brown compound formed in reacting $Mo(CO_6)$ with $(ROCS_2)_2$ is also believed to have a structure very similar to the thiocubane structure of the purple compound based on its ease of formation from the purple compound and chemical analysis.

While not wishing to be bound by a particular theory, the hydroperoxides in the oil are believed to contact the heterogeneous hydroperoxide decomposer and be catalytically decomposed into harmless species that are soluble in the oil.

The precise amount of hydroperoxide decomposer used can vary broadly, depending upon the amount of hydroperoxide present in the lubricant. However, although only an amount effective (or sufficient) to reduce the hydroperoxide content of the lubricating oil need be used, the amount will typically range from about 0.05 to about 2.0 wt. %, although greater amounts could be used. Preferably, from about 0.01 to about 1.0 wt. % (based on weight of the lubricant) of the hydroperoxide decomposer can be used.

The heterogeneous hydroperoxide decomposers can be immobilized in some manner when contacting the oil. For example, they can be immobilized on a substrate. However, a substrate would not be required if the hydroperoxide decomposer used were the crystalline form of $MO_4S_4(ROCS_2)_6$ wherein R is $C_2H_5$. Preferably, the substrate will be located within the lubrication system (e.g., on the engine block or near the sump)and the substrate will be part of the filter system for filtering the engine's lubricating oil, although it could be separate therefrom. Suitable substrates include, but are not limited to, alumina, activated clay, cellulose, cement binder, silica-alumina, and activated carbon. Alumina, cement binder, and activated carbon are preferred substrates, with activated carbon being particularly preferred. The substrate may (but need not) be inert and can be formed into various shapes such as pellets or spheres.

The hydroperoxide decomposer may be incorporated on or with the substrate by methods known to those skilled in the art. For example, if the substrate were activated carbon, the hydroperoxide decomposer can be deposited by using the following technique. The hydroperoxide decomposer is dissolved in a volatile solvent. The carbon is then saturated with the hydroperoxide decomposer-containing solution and the solvent evaporated, leaving the hydroperoxide decomposer on the carbon substrate.

Hydroperoxides are produced when hydrocarbons in the lubricating oil contact the peroxides formed during the fuel combustion process. As such, hydroperoxides will be present in essentially any lubricating oil used in the lubrication system of essentially any internal combustion engine, including automobile and truck engines, two-cycle engines, aviation piston engines, marine and railroad engines, gas-fired engines, alcohol (e.g. methanol) powered engines, stationary powered engines, turbines, and the like. In addition to hydroperoxides, the lubricating oil will comprise a major amount of lubricating oil basestock (or lubricating base oil) and a minor amount of one or more additives. The lubricating oil basestock can be derived from a wide variety of natural lubricating oils, synthetic lubricating oils, or mixtures thereof. In general, the lubricating oil basestock can have a viscosity in the range of about 5 to about 10,000 cSt at 40° C., although, in some embodiments, the oil can have a viscosity ranging from about 10 to about 1,000 cSt at 40° C.

Strong Base Chemical Filter

Another embodiment of a chemical filter having in accordance with the invention can be employed within the lubrication system of internal combustion engines to immobilize combustion acids by immobilizing a strong base within the filter as described in parent U.S. patent application Ser. No. 11/133,530. Soluble weak bases ("dispersants") are typically employed in commercial lubricants to help neutralize combustion acids and to prevent agglomeration of soot particles.

The combustion acids and soot particles enter the lubricant with combustion blow-by gases and through the boundary layer of lubricant that may or may not: contain recirculated exhaust gas. Neutralization preferably occurs before the acids reach metal surfaces to produce corrosion or piston deposits and before the soot particles form a three dimensional, viscosity-increasing structure. The weak bases and combustion acids interact to form combustion acid-weak base complexes (or salts) that travel within the lubricating oil. Aspects of the present invention provide chemical filters that employ some media comprising a strong base material. These filters can be placed at any location within the lubrication system, such as, for example, the location of a traditional oil filter. The strong base material in the chemical filter displaces the weak base from the combustion acid-weak base complex. Once the weak base has been displaced from the soluble neutral salts, the combustion acid-strong base salts thus formed will be to a large degree immobilized as heterogeneous deposits with the strong base in the filter or with the strong base on a substrate if one is used. Thus, combustion acid neutralized salts which would normally form deposits in the piston ring zone now occur outside this zone when the soluble salts contact the strong base. The combustion acids accordingly are sequestered in the chemical filter and the displaced weak base material is effectively recycled to neutralize subsequently produced acids. This displacement functions via ion exchange whereby the strong base disposed in the chemical filter exchanges with the weak base in the combustion acid-weak base complex. As a result, the weak base is regenerated and recycled with the lubricant to neutralize additional acid. This process is illustrated in schematic form in FIG. 10 and is discussed in more detail below.

In some embodiments, the chemical filter can lengthen the time between oil drains by providing an additional mechanism to sequester combustion acids and disperse soot. In addition, piston deposits and corrosion can be reduced by transferring combustion acids from combustion acid-weak base complexes in the oil and immobilizing them with the strong base. The recycling of dispersant weak base materials for reuse in the dispersion of soot can minimize the increase of viscosity due to soot agglomeration.

The strong base can be incorporated, e.g. impregnated, on or with a substrate immobilized in the device of the lubricating system of the engine. The device is preferably located subsequent to (or downstream of) the piston ring zone. Thus, the device can be located on the engine block or near the sump. Preferably, the device includes the substrate incorporated into the filter system for filtering oil, or the traditional oil filter. In other embodiments, the device is distinct from the traditional oil filter and can include a chemical filter, which is a substrate having strong base incorporated therewith.

Suitable substrates include, but are not limited to, alumina, activated clay, cellulose, cement binder, silica-alumina, and activated carbon. The alumina, cement binder, and activated carbon are preferred. The substrate may be inert or not inert.

The strong base can be incorporated on or with the substrate by methods known to those skilled in the art. For example, for the substrate alumina, the strong base can be deposited by using the following technique. A highly porous alumina is selected. The porosity of the alumina is determined by weighing dried alumina and then immersing it in water. The alumina is removed from the water and the surface water removed by blowing with dry air. The alumina is then reweighed and compared to the dry alumina weight. The difference in weight is expressed as grams of water per gram of dry alumina. A saturated solution of magnesium oxide in a suitable polar solvent is prepared. This solution is then added to the dry alumina in an amount equal to the difference between the weight of wet and dry alumina. The polar solvent is removed from the alumina with heat leaving MgO deposited on the alumina as the product. This preparation can be carried out at and ambient conditions, except the) solvent removal step is performed at a higher temperature or at low pressure.

The amount of strong base required will vary with the amount of weak base in the oil and the amount of combustion acids formed during engine operation. Although any amount of strong base in the chemical oil filter would be beneficial, since the strong base is not being continuously regenerated for reuse as is the weak base (i.e., the dispersant), the amount of strong base should be at least equal to a ⅓ the equivalent weight of the weak base in the oil. Therefore, the amount of strong base should be from ⅓ to about 15 times, preferably from ⅓ to about 5 times, the equivalent weight of the weak base in the oil.

Once the weak base has been displaced from the soluble neutral salts, the strong base/strong combustion acid salts thus formed will be immobilized as heterogeneous deposits within the filter, i.e. away from the piston. Only those combustion acid salts remaining in the lubricant can form polar deposits on the piston. Thus piston deposits are decreased as combustion acids are immobilized in the chemical oil filter. Preferably, the strong base will be located such that it can be easily removed from the lubrication system, e.g., included as part of the oil filter system where the strong base can be removed along with removal or changing of the traditional oil filter.

Top-Up-Oil

Some aspects of the present invention include a top-up-oil that supplements the lubricant lost during the operation of the combustion engine. Since lubricant additives are not used up at the same rate, the top-up oil typically includes substantially elevated amounts of at least one lubricant additive. For example, the top up oil can contain from the same to about ten times the concentration of ashless anti-oxidants as is in the initial oil charge, or lubricant; from the same to about five times the concentration of dispersant as is in the initial oil charge; and from the same to about four times the concentration of viscosity modifier as in the initial oil charge.

The normal practice is to use fresh oil lubricant for top up that is the same as the original lubricant. In accordance with the invention, the top up need not be the same as the original lubricant as it is specially formulated to replace the constituents that are removed from the lubricant over time. Thus, while the original charge is a lubricant, the top-up-oil is not a lubricant because it is not a balanced lubricant formulation and would not work well as a lubricant. There are sound technical reasons why the top-up-oil is different than the fresh lubricant. These reasons revolve around the rate of depletion of different additives in the fresh lubricant. The anti-oxidant is consumed as part of its function and is therefore depleted at a fairly fast rate. The dispersant with current technology is also consumed as part of its function of neutralizing combustion acids. However, in accordance with the invention the dispersant is recycled for reuse and is consumed by dispersing soot and sludge and by a slow oxidative and thermal degradation and thus its rate of depletion is less than that of the anti-oxidant. The molecular weight of the viscosity modifier is reduced by shear stress and thus its effectiveness slowly decreases but also at a slower rate than the anti-oxidant is depleted. As a result, it is necessary that the concentration of these three additives be different in the top-up-oil than they are in the fresh oil since the intent is to bring the relative concentrations of these additives in the lubricant back to that of the fresh oil charge.

The lubrication system can provide an extended oil drain interval and approach a never-drain oil. The top-up-oil acts to compensate for oil consumption lost as a part of normal operation of the combustion engine and lubrication system. Much of the oil is lost via escape between the piston rings and piston chamber, which ultimately is burned off in the combustion chamber. The top-up-oil also replenishes lubricant additives in the lubricant. Each of these lubricant additives is consumed or loses their potency at different rates. As such, the lubricant additives in the top-up-oil have a different ratio than they do in an initial fresh oil charge.

The anti-wear additive is consumed as it forms a protective wear layer on metal surfaces. Because the normal anti-wear additive contains a metal and phosphorus it is desirable not to introduce a surge of ash precursors and phosphorus with a top-up oil. Such a surge of ash precursors would foul the exhaust gas particle filter and the phosphorus would poison the emission catalyst. Thus, the anti-wear additive will be replenished by slow release from the device, such as the chemical oil filter, and anti-wear additive can be at a low concentration or absent from the top-up oil.

The ashless anti-oxidant is also consumed during normal engine operation. The lubrication system can provide excellent oxidative protection by maintaining a relatively high level of anti-oxidant in the top-up oil, from twice to about ten times the concentration in the initial oil charge.

The dispersant is degraded in potency during normal engine operation. Pendant polyisobutylene groups solubilize a common ashless dispersant, but despite the excellent oxidative protection for the lubricant, some degradation of the polyisobutylene will occur. This degradation decreases the molecular weight of the polyisobutylene and the effectiveness of the dispersant. To compensate for this decrease in dispersant potency, the top-up-oil can contain from the same to about five times the concentration of dispersant as in the initial oil charge.

The viscosity modifier is slowly degraded in potency by, e.g., shear acting on the high molecular weight polymer to lower its molecular weight, which can degrade its potency in viscosity modification. To compensate for this decrease in the ability of the viscosity modifier to maintain the proper viscosity, the top-up-oil can contain from the same to about four times the concentration of viscosity modifier as is in the initial oil charge.

The top-up-oil preferably comprises lubricant additives that do not substantially contribute to SAPS levels, e.g., anti-oxidants, dispersants and viscosity modifiers. The level of dispersants, anti-oxidants, and viscosity modifiers are substantially elevated compared to a fresh lubricant charge. In some embodiments, the top-up-oil can have significantly reduced levels of detergent, and preferably, substantially no detergent.

Lubricant

The lubricating (or crankcase) oil circulating within the lubrication system of a typical internal combustion engine will comprise a major amount of a lubricating oil basestock (or base oil) and a minor amount of one or more additives. The lubricating oil basestock can be derived from natural lubricating oils, synthetic lubricating oils, or mixtures thereof. In general, the lubricating oil basestock will have a viscosity in the range of about 5 to about 10,000 cSt at 40° C., although typical applications will require an oil having a viscosity ranging from about 10 to about 1,000 cSt at 40° C.

Natural lubricating oils include animal, vegetable (e.g., castor oil and lard oil), petroleum, or mineral oils.

Synthetic lubricating oils include alkylene oxide polymers, interpolymers, and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-poly isopropylene glycol ether having an average molecular weight of 1000, diphenyl ether of poly-ethylene glycol having a molecular weight of 500-1000, diethyl ether of polypropylene glycol having a molecular weight of 1000-1500); and mono- and polycarboxylic esters thereof (for example, the acetic acid esters, mixed $C_3$-$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyakyl-, polyaryl, polyalkoxy-, or polyaryloxysiloxane oils and silicate oils comprise another useful class of synthetic lubricating oils; they include tetraethyl silicate, tetraisopropyl silicate, tetra-(2-ethylhexyl) silicate, tetra-(4-methyl-2-ethylhexyl) silicate, tetra (p-tert-butylphenyl) silicate, hexa-(4-methyl-2-pentoxy) disiloxane, poly(methyl) siloxanes and poly(methylphenyl) siloxanes. Other synthetic lubricating oils include liquid esters of phosphorus-containing acids (e.g., tricresyl phosphate, trioctyl phosphate, diethyl ester of decylphosphonic acid); polymeric tetrahydrofurans, and polyalphaolefins.

The lubricating oil, or lubricant, can be derived from unrefined, refined, and re-refined oils. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Re-refined oils are obtained by treating refined oils in processes similar to those used to obtain the refined oils. These re-refined oils are also known as reclaimed or reprocessed oils and often are additionally processed by techniques for removal of spent additives and oil breakdown products.

Lubricant Additives

Weak Base in Lubricant

The lubricating oil can include a weak base, which will normally be added to the lubricating oil during its formulation or manufacture. The weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof. Examples of basic organonitrogen compounds include, but are not limited to, pyridines, anilines, piperazines, morpholines, alkyl, dialkyl, and trialky amines, alkyl polyamines, and alkyl and aryl guanidines. Alkyl, dialkyl, and trialkyl phosphines are examples of basic organophosphorus compounds.

Examples of particularly effective weak bases are the dialkyl amines ($R_2$ HN), trialkyl amines ($R_3$ N), dialkyl phosphines ($R_2$ HP), and trialkyl phosphines ($R_3$ P), where R is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri- alkyl phosphines and the di- and trialkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinic anhydride with more than 60 carbons in the polybutenyl group.

The weak base must be strong enough to neutralize the combustion acids (i.e., form a salt or a soluble or dispersible complex). Suitable weak bases preferably have a pKa from about 4 to about 12. However, even strong organic bases (such as organoguanidines) can be utilized as the weak base if the strong base is an appropriate oxide or hydroxide and is capable of releasing the weak base from the weak base-combustion acid complex.

The molecular weight of the weak base should be such that the weak base-combustion acid complex retains its oil solubility. Thus, the weak base should have sufficient solubility so that the salt formed does not separate from the oil. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize practically all acid as it enters the lubricant. Typically, the amount will range from about 0.01 to about 6 weight percent dispersant polymer or more, preferably from about 0.1 to about 4 weight percent dispersant polymer. Dispersant is usually sold and used as a concentrate containing, at least in some cases, 50 weight percent dispersant polymer and 50 weight percent oil. At high concentrations, weak base dispersants can increase viscosity. The use of EGR has increased the acid load on the lubricant and increased the dispersant in the lubricant to the maximum commensurate with viscosity requirements.

Lubrication System

Figure 2:
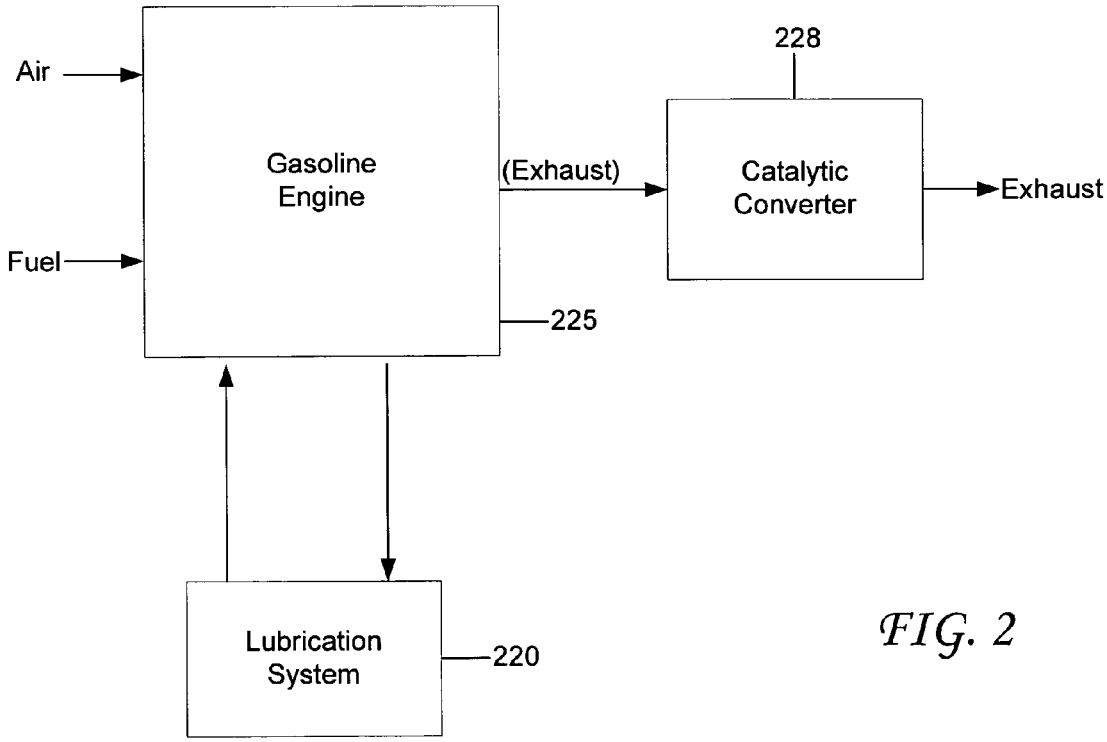
FIG. 2 is a schematic of one embodiment of the lubrication system of the invention for use with a gasoline engine.

The lubrication system of the invention combines the above components in a fashion such that it can work with any internal combustion engine. In FIG. 1, the lubrication system 210 is shown in fluid connection with a diesel engine 215. The diesel engine 215 includes after-treatment devices, shown as a NO, removal system 217 and a particulate filter 219. As illustrated, an exhaust gas recirculation system may also be provided. FIG. 2 shows a lubrication system 220 that is in fluid connection with a gasoline engine 225. The gasoline engine 225 is equipped with an after treatment mechanism, such as a catalytic converter 228, in conventional fashion.

The $NO_x$ removal system 217, particulate filter 219, and catalytic converter 228 represent treatment devices that can be used to intercept the exhaust from an engine and decrease pollutant levels released into the environment. Many countries have emission standards that necessitate the incorporation of an after-treatment mechanism to all combustion engine exhausts. Furthermore, it is recognized that industry or government standards can require after-treatment mechanisms, or after-treatment devices, to have a certain life cycle. In other words, the after-treatment mechanisms are required to operate for a length of time as measured by the duration of operation of the associated engine. Often, the life cycle is measured in terms of miles under which the engine is in operation. It is further recognized that an increase in SAPS can significantly reduce the lifecycle of such after treatment devices; therefore, reduction in SAPS levels, without significantly reducing the performance of the lubricant, can greatly improve the life cycle of the after-treatment devices.

Figure 3:
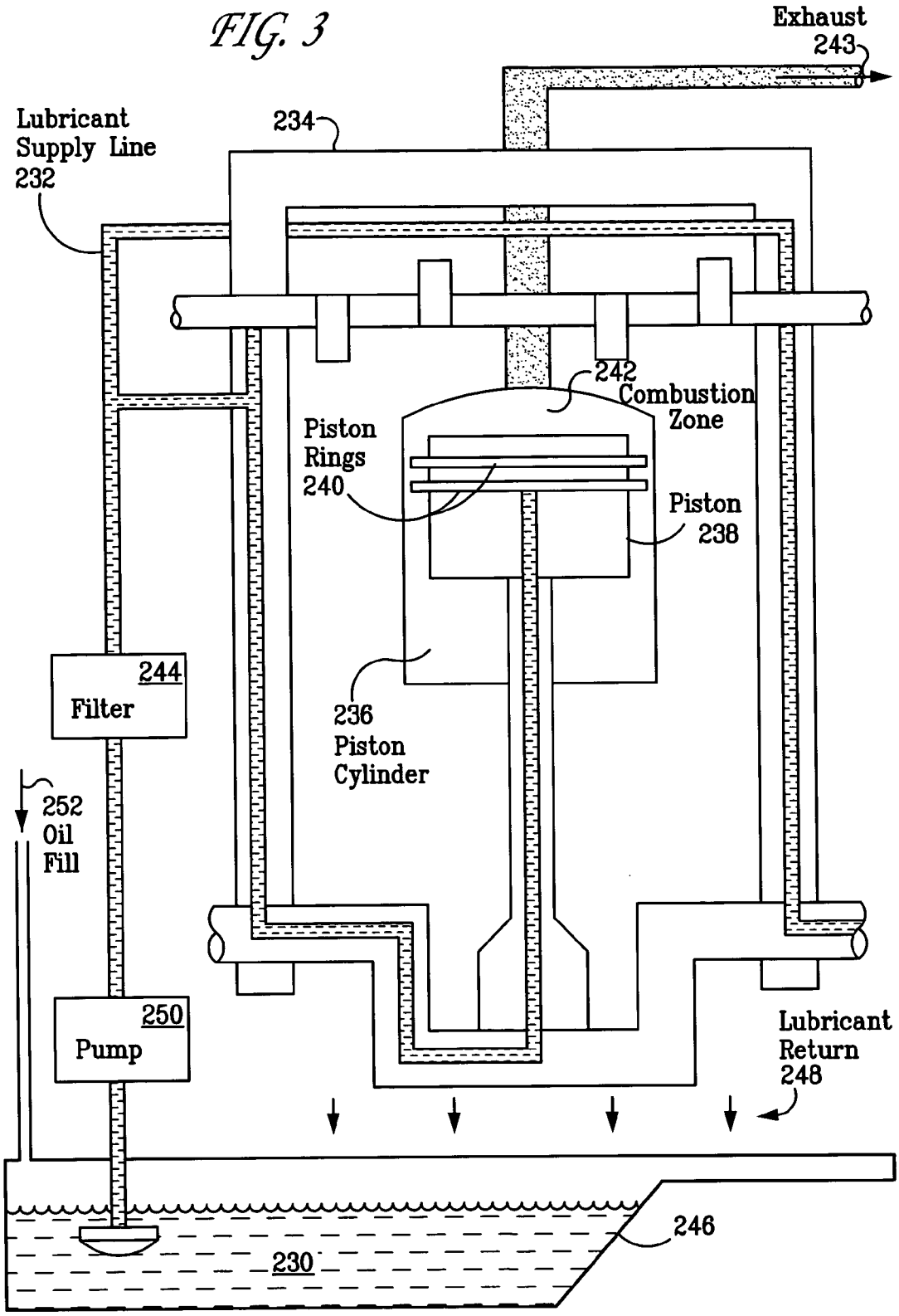
FIG. 3 illustrates a schematic of a lubrication system of the invention comprising a chemical lubricant filter.

FIG. 3 illustrates one embodiment of a lubrication system in fluid communication with a combustion engine in accordance with the invention. Lubricant 230 is shown traveling through a lubricant supply line 232 and interacting with an internal combustion engine 234, as shown in an exploded view of a piston cylinder 236 in FIG. 3, which includes a piston 238 having piston rings 240 within combustion zone 242. By-products of the combustion in the combustion zone 242 are output to the after-treatment device via exhaust 243. The lubricant 230 also is in fluid communication with a device 244, which can either be a chemical filter or a metering device. In the instances where the device 244 is a chemical filter, a traditional oil filter also may be located in the lubricant supply line 232 and in fluid communication with the lubricant 230. Of course, the traditional oil filter and chemical filter could be combined into the same element, as described in related U.S. patent application Ser. No. 11/133,530. The lubricant 230 is returned to a lubricant sump 246 via lubricant return 248 and via a lubricant pump 250 is recirculated throughout the lubricant supply line 230 towards the combustion engine 234. Additionally, a top-up-oil 252 is shown entering into the lubricant sump 244 and adding to the level of lubricant 230.

Figure 4:
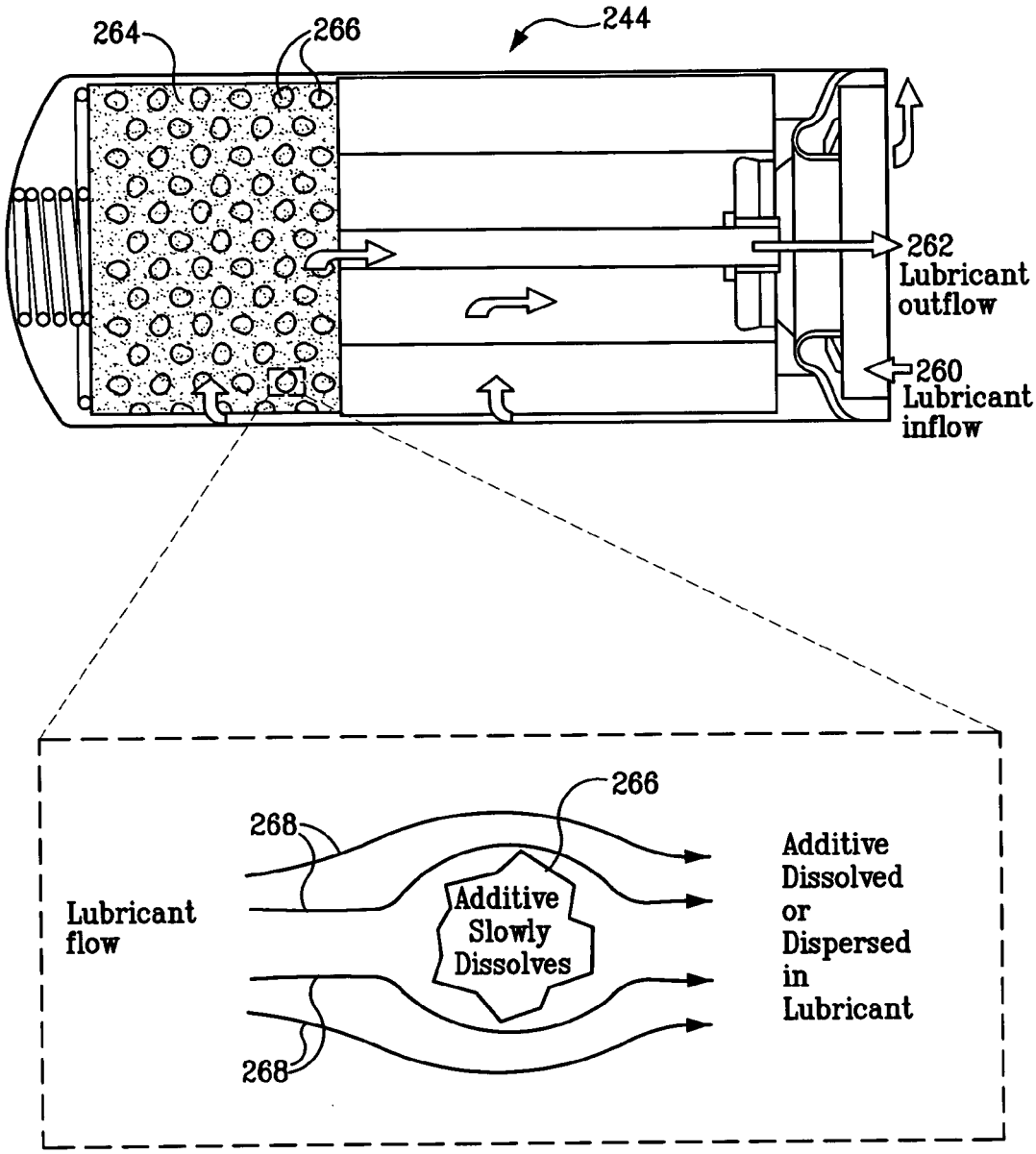
FIG. 4 is a vertical cross-section of a chemical filter of the invention in which lubricant additives in the chemical filter are released into the lubricant to a concentration controlled by the equilibrium solubility of each additive.

As shown in FIG. 4, a chemical oil filter 244 is shown along with arrows representing inflow 260 and outflow 262 of lubricant with respect to the chemical filter 244. The chemical filter 244 includes a matrix [or substrate] 264 that has a solid lubricant additive 266 attached to it. A blowup of the lubricant additive 266 shows it enveloped within lubricant that is in fluid flow, the flow represented by the multiple arrows 268 surrounding the solid lubricant additive 266. As the lubricant flows around the solid lubricant additive 266, it dissolves into the lubricant under standard solubility rate kinetics, thereby increasing the concentration of the solid lubricant additive to the lubricant. Preferably, the rate of solubility will provide for a constant concentration of the lubricant additive in the lubricant—matching the amount lost through burn off at the combustion chamber or consumption.

Figure 5:
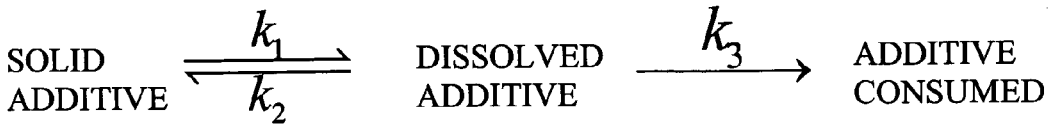
FIG. 5 shows the kinetics and equilibrium that underlies the embodiment of FIG. 4 of the invention and includes equilibrium controlled solubility lubricant additives.

FIG. 5 shows one example of slowly releasing lubricant additives from a fixed location, within a device, into the lubricant. As illustrated, there is a concentration equilibrium relationship between solid additive, dissolved additive and consumed additive. An equilibrium constant K exists between the solid lubricant additive and the dissolved additive and involves the rate at which the solid dissolves ($k_1$), which is countered by the rate at which dissolved lubricant additive re-deposits or precipitates ($k_2$). Additionally, because some lubricant additive is eventually degraded or consumed, or lost through escape into the engine's combustion chamber, there is a rate at which lubricant additive is consumed ($k_3$). The constant $k_3$ modifies K to give the actual equilibrium constant. The equilibrium constant is large for highly soluble materials such as conventional ZnDDP or commercially available ZnDDP; however, by reducing the length of the long alkyl chain moieties or other chemical changes known to those skilled in the art, equilibrium solubility of the highly soluble material can be significantly reduced.

Figure 6:
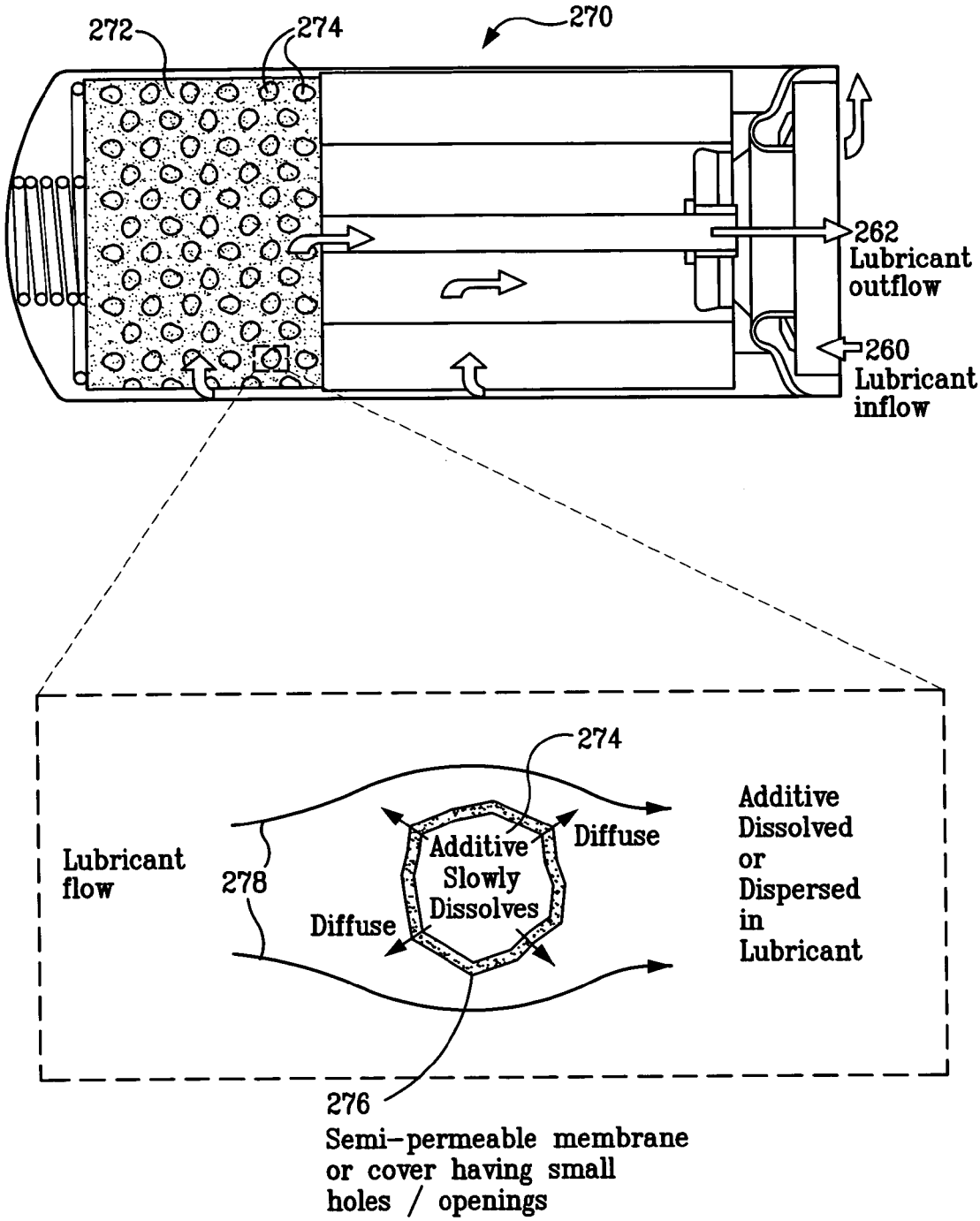
FIG. 6 is a vertical cross-section of a chemical lubricant filter of the invention in which lubricant additives in the chemical lubricant filter are released into the lubricant by slowly diffusing through a membrane or porous solid.

FIG. 6 illustrates a chemical oil filter 270 along with arrows representing inflow 260 and outflow 262 of lubricant with respect to the chemical oil filter 270. The chemical oil filter 270 includes a matrix [or substrate] 272 that has a solid lubricant additive 274 attached to it. A blowup of the lubricant additive 274 shows it encased or enveloped in a semi-permeable membrane 276. The semi-permeable membrane 276 has a plurality of small holes or openings. The solid lubricant additive 274 is also enveloped within lubricant that is in fluid flow, the flow represented by the multiple arrows 278 surrounding the solid lubricant additive 274. As the lubricant flows around the lubricant additive 274, lubricant additive diffuses into the lubricant under standard solubility and diffusion rate kinetics, thereby increasing the concentration of the lubricant additive 274 in the lubricant steadily over time. Preferably, the rate of solubility will provide for a constant concentration of the lubricant additive in the lubricant—matching the amount lost through burn off at the combustion chamber or consumption as, e.g., anti-wear additive is worn off between sliding metal parts. Other devices or techniques that control the rate at which additive enters the lubricant via a diffusion-related mechanism are possible and envisioned. One such possibility might be a closed container with small openings through which an additive must diffuse; another possibility is a tubular coil out of which an additive must migrate. See, for example, U.S. Pat. No. 5,718,258. Further, additives may be incorporated into polymers which are oil permeable at elevated temperatures or into particles which are oil-insoluble, but oil-wettable. See, for example, U.S. Pat. No. 4,066,559 or 5,478,463. In another approach, solid oil-soluble polymers that may function as viscosity modifiers and that may contain additives within may be used to achieve slow release. See, for example U.S. Pat. No. 4,014,794.

Figure 7:
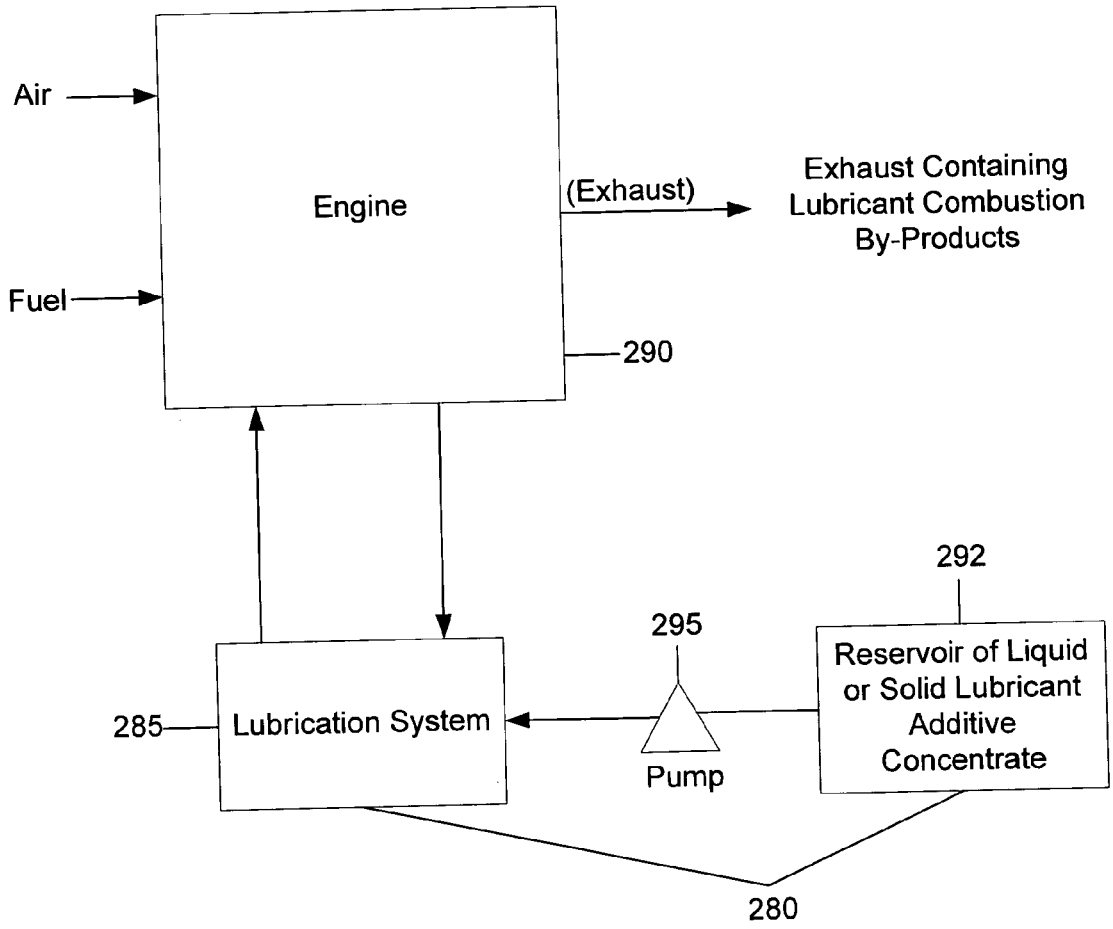
FIG. 7 illustrates a schematic of an embodiment of the present invention that includes a pump to meter lubricant additives from a reservoir for insertion into the lubricant.

FIG. 7 illustrates a schematic of another embodiment of the present invention in which lubricant additives are released into circulating lubricant via a metering device. A lubrication system 280 is shown to include lubricant a conventional lubrication system 285 that is in fluid communication with an internal combustion engine 290. As illustrated, a reservoir 292 housing solid or liquid lubricant additive concentrate communicates with the lubrication system 285 via a metering device, such as pump 295, which provides a controlled fluid connection between the reservoir 292 and the lubricant system 285. The metering device 295 can be controlled to slowly release the lubricant additive stored in the reservoir 292 into the lubricant 285. Preferably, the release will be at a rate to provide a constant concentration of the lubricant additive to provide effective engine protection without deleterious effect on the engine or the after treatment mechanisms, as discussed herein and generally known in the art.

Figure 8:
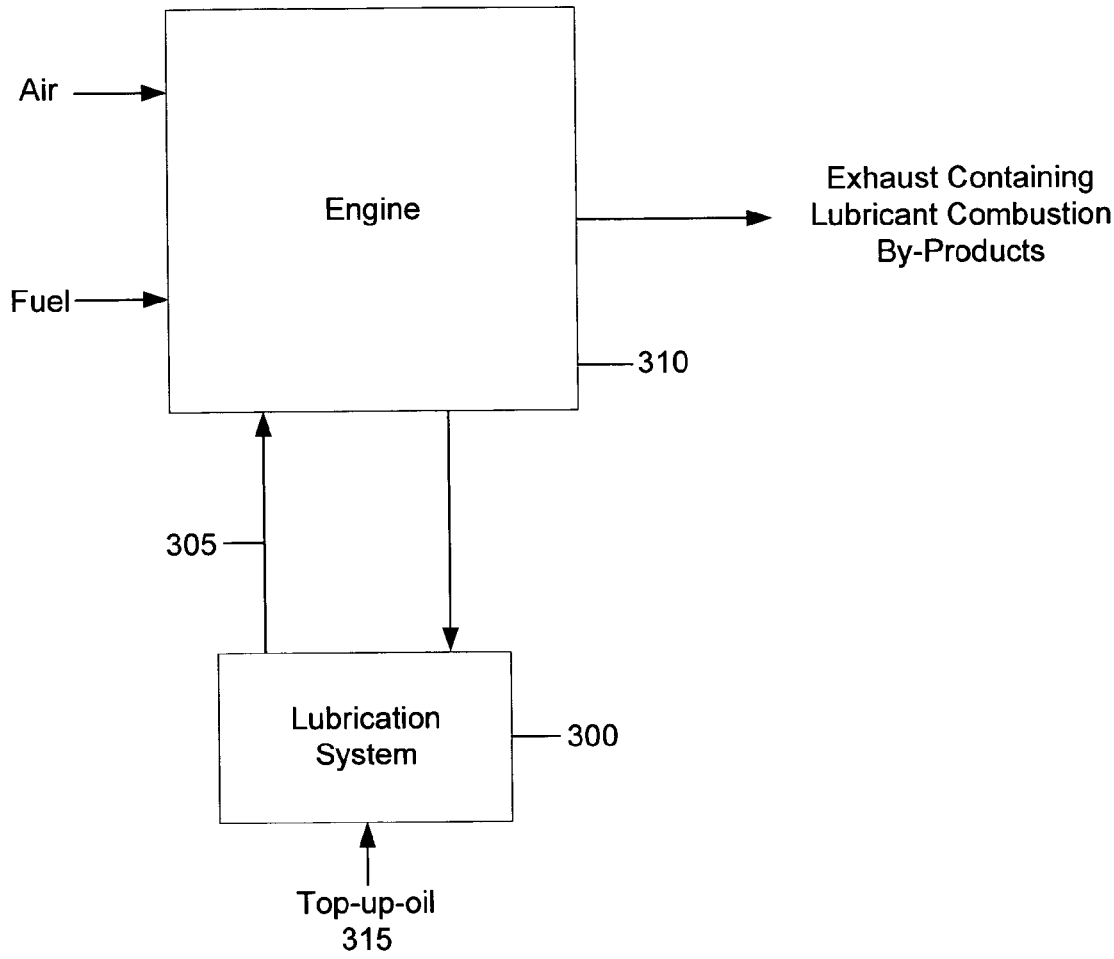
FIG. 8 illustrates a schematic of an embodiment of the present invention that includes top-up-oil.

FIG. 8 illustrates a schematic of yet another embodiment of the present invention in which a top-up-oil is included in the lubrication system. As shown, lubrication system 300 includes lubricant 305 that is in fluid communication with an internal combustion engine 310. Also, top-up-oil 315 is added to the lubrication system 300 by fluid mixing in, for example, a lubricant sump. By addition of a top-up-oil 315, the lubricant 305 can have an increased lifecycle as concentrations of lubricant additives are added via the top-up-oil 315. This ultimately leads to decreased oil changes, which provides added value to society as waste oil and the frequency of oil changes are reduced.

Figure 9:
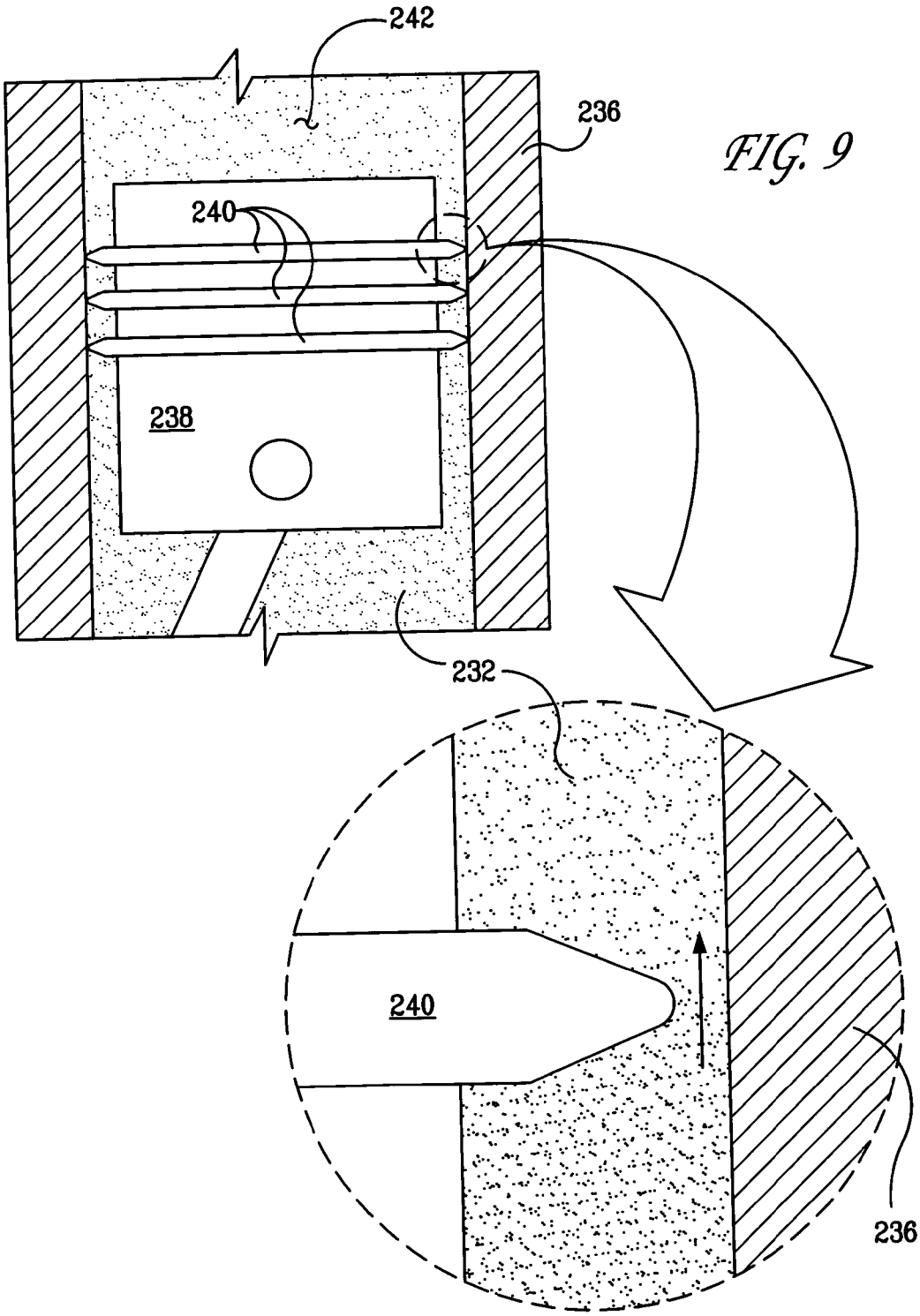
FIG. 9 shows an engine piston within its piston chamber to illustrate the loss of lubricant between the piston rings and chamber.

FIG. 9 illustrates a blow up view of a vertical cross-section of a piston chamber of an internal combustion engine of the type shown in FIG. 3 in order to better illustrate lubricant loss via ring slippage. A piston chamber 236 is shown to include a piston 238 having piston rings 240 that abut walls of piston chamber 236. Surrounding the piston 238 is lubricant 232. As illustrated, some of the lubricant 232 slips past the piston rings 240 as the piston 238 moves back and forth within the piston chamber 236. Eventually, some amounts of the lubricant 232 slips past the piston rings 240 and into the combustion chamber 242 where the lubricant 232 is burned and lost. The exploded view shows ring slippage of lubricant 232. Such slippage leads to the loss of lubricant and the need for top-up-oil as described above.

FIGS. 10-27 below relate to a chemical filter for use in the system described above. The description with respect to such figures can be found in the co-pending U.S. patent application Ser. No. 11/133,530 referenced above and incorporated herein by reference. As noted above, the strong base may be replaced in the chemical filter by a suitable anti-oxidant such as a hydroperoxide decomposition agent or radical scavenger or a combination thereof.

Figure 10:
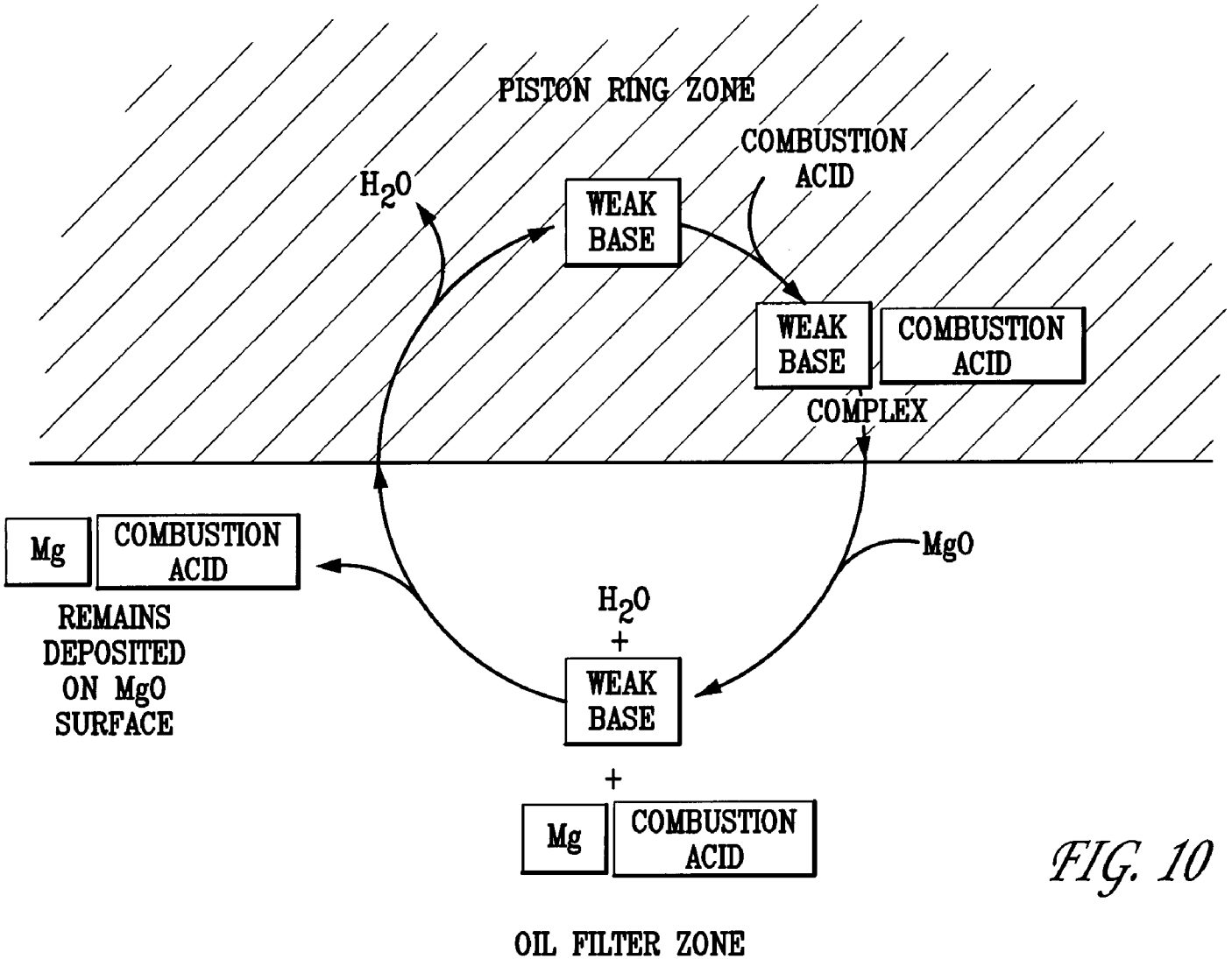
FIG. 10 is a schematic of one manner of how chemical filters of the present invention can function within the lubrication system of an internal combustion engine.

FIG. 10 illustrates a diagram of the recycling of weak base as ion exchange of the combustion acid is provided by the strong base incorporated into a chemical filter of the present invention. Weak base at the site of production of the combustion acid, i.e., the piston ring zone, complexes with the combustion acid. This complex flows with the lubricant in circulation until it reaches the strong base in the filter, where there is an ion exchange. The ion exchange releases the weak base as the combustion acid complexes with the strong base.

Figure 11:
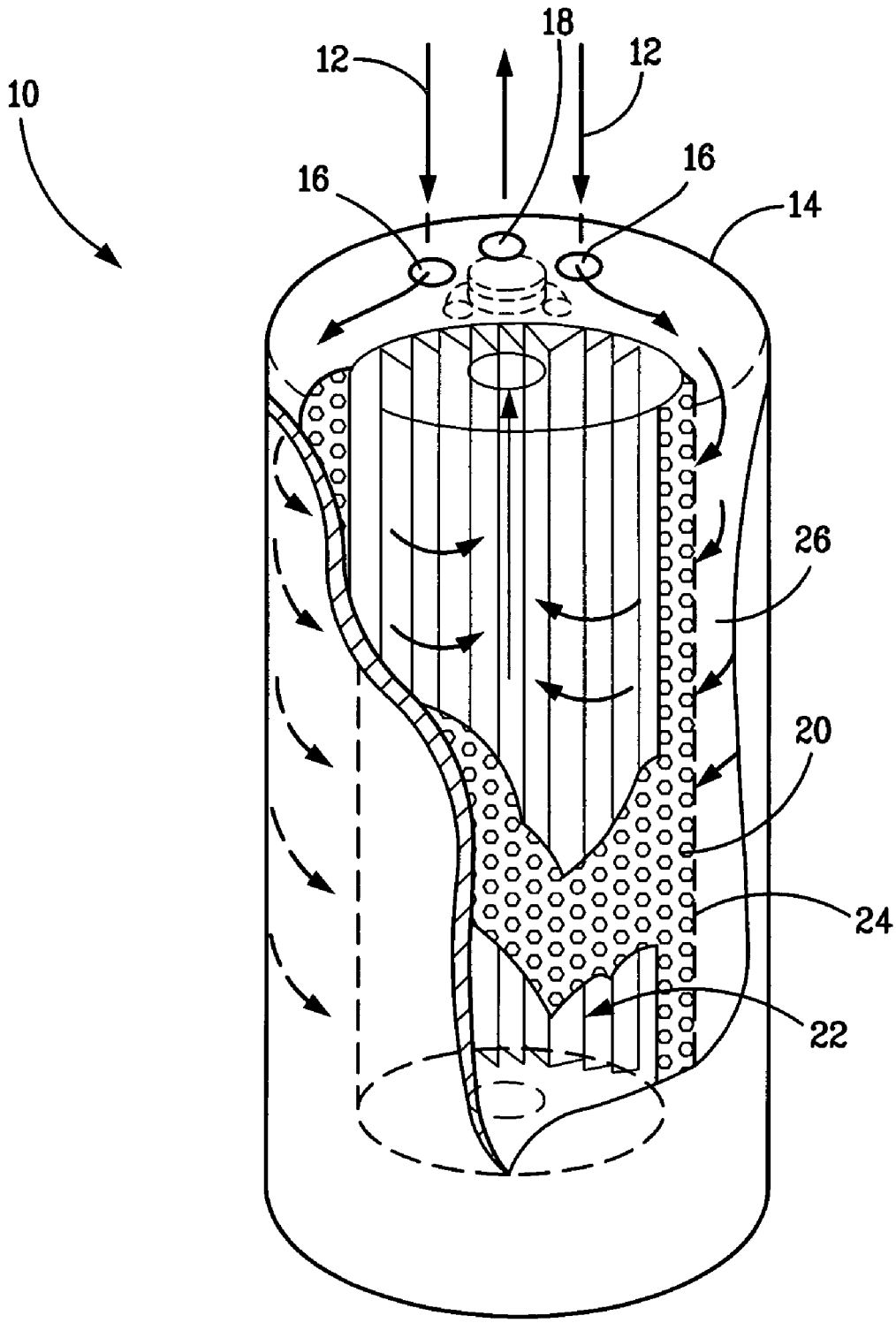
FIG. 11 is a perspective view of a chemical filter embodiment of the present invention.
Figure 12:
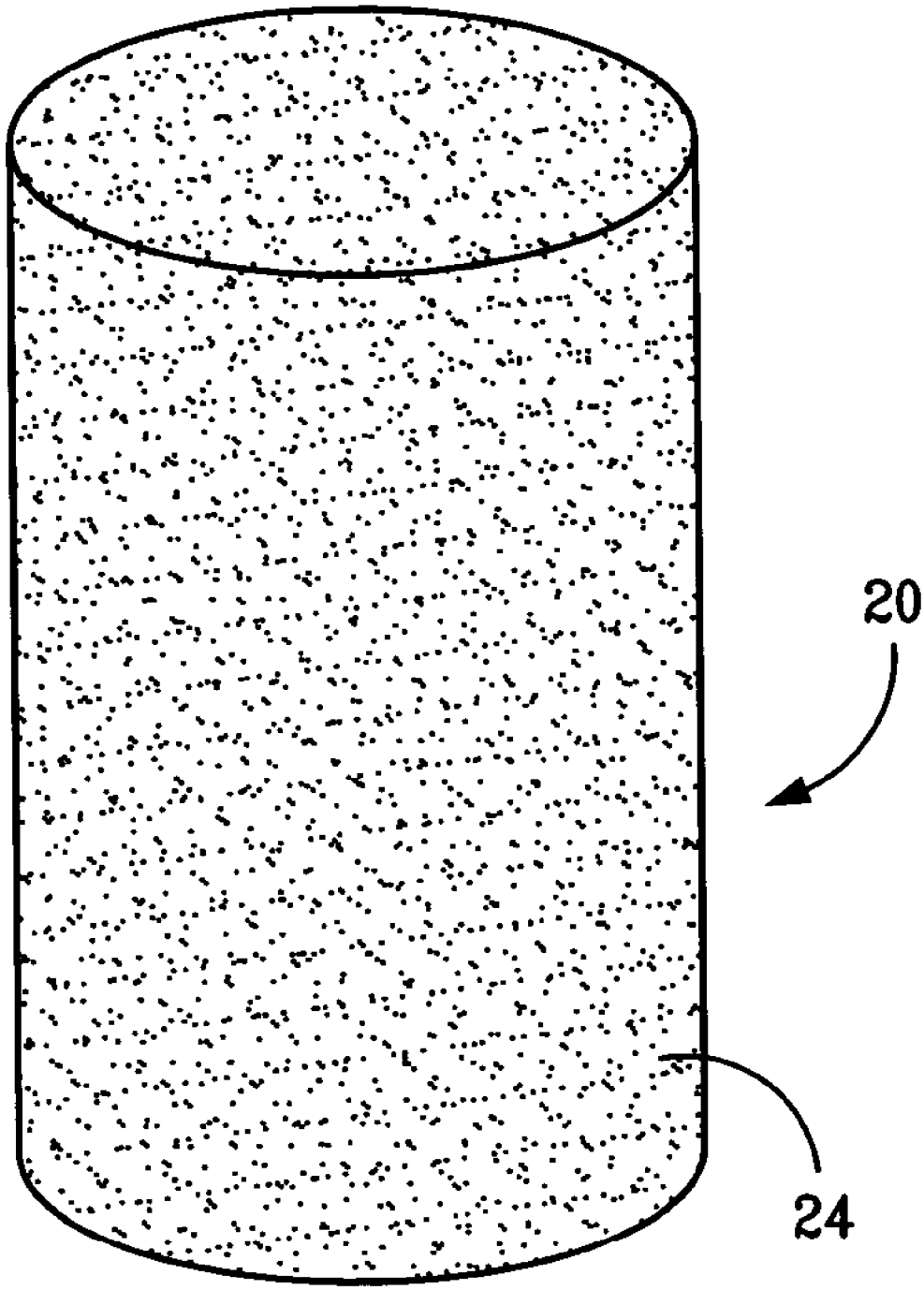
FIG. 12 is a perspective view of a chemically active filter member as provided in accordance with an embodiment of the present invention.

As shown in FIG. 11, an exemplary chemical filter 10 is created, which is a modified conventional oil filter. Lubricating oil 12 is passed into a filter housing 14 having one or more oil inlets 16 and an oil outlet 18. Within filter housing 14 is a chemically active filter member 20 surrounding an inactive size-exclusion filter member 22. Chemically active filter member 20 includes filtration media 24 that contains a strong base material that will be described in more detail below. As shown more clearly in FIG. 12, chemically active filter member 20 is in the form of a cylindrical filter insert that can be sized and configured for disposition in a non-limited variety of positions, including that shown in FIG. 11 (i.e., radially outward from inactive size-exclusion filter member 22). A chemically active filter member or insert 20 can be formed into solid, porous structures with employment of binders and known processes for binding particulate matter, as discussed in more detail below.

As also shown in FIG. 11, oil containing combustion acid-weak base complexes enter filter housing 14 through inlets 16 and travels down annular space 26. The oil then flows radially inward and passes, in series, through chemically active filter member 20 and inactive size-exclusion filter member 22. When passing through chemically active filter member 20, the strong base material associated with filtration media 24 displaces the weak base from the complexes, thereby immobilizing the combustion acids in chemical filter 10. The oil containing recycled weak base material then exits filter 10 through outlet 18, and the recycled weak base material is made available to neutralize additional combustion-related acids. The features of chemical filter 10, and configuration of the same, is exemplary only and is not limiting for purposes of properly construing the appended claims. Furthermore, chemically active filter member 20 and filtration media 24 are drawn simply to illustrate that chemically active filter member 20 includes a collection of particulate matter that permits the through flow of oil. The figure is not intended to represent actual dimensionality of filtration media provided by the present invention. Some embodiments, having a certain size and distribution of the particulate matter, and the size and distribution of interstitial pores defined between adjacent particles, will be described in more detail below.

Figure 13:
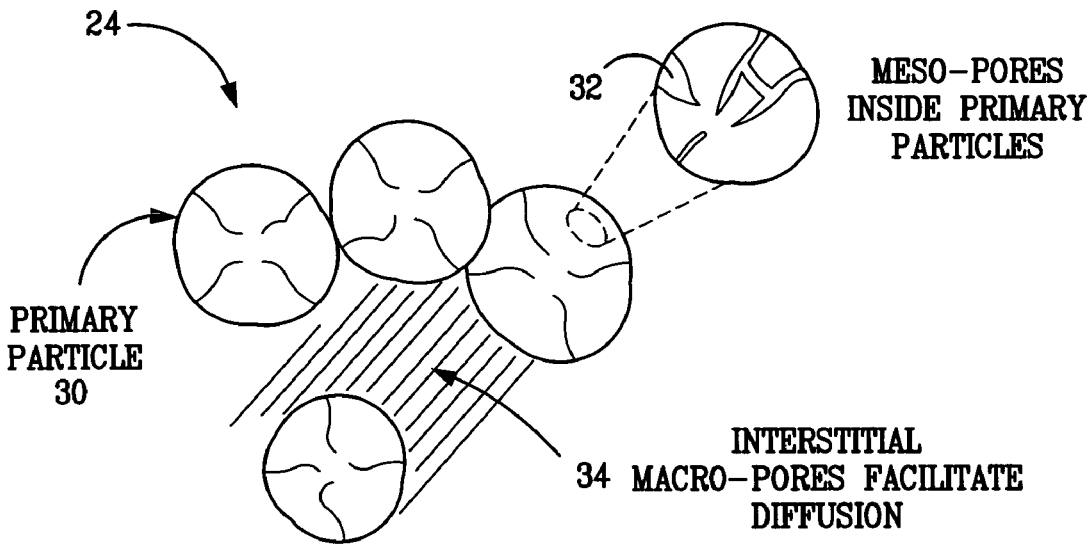
FIG. 13 is a schematic of filtration media particles suitable for use in chemical filters of the present invention.

Filtration media 24 includes a collection of particles that are held closely together. FIG. 13 is a schematic of exemplary filtration media 24 that includes primary particles 30, which include internal pores 32, and interstitial pores 34 defined between adjacent particles 30 and that facilitate diffusion. The pore diameter of a majority of interstitial pores 34 is preferably less than about 1 millimeter, and more preferably less than about 500 micrometers. In preferred embodiments, interstitial pores 34 are substantially uniformly distributed so as not to cause excessive channeling or flow through only a few portions of the filtration media. The interstitial pores are preferably large enough to allow debris, which is capable of arising in a lubrication system, to pass through the filtration media 24 without blockage or excessive pressure buildup. The size and distribution of the interstitial pores 34 can vary to a certain degree from the noted preferred characterizations while still being useful in accordance with the present invention. As used herein the term "filtration media pores" includes both internal pores and interstitial pores.

The particles are preferably bound together with a binder material. The particles can alternatively be held closely together with physical constraints (with or without employment of a binder), such as, for example, entrapped within or disposed on a surface of a fibrous web, or disposed on a sheet of filter paper or between multiple sheets of filter paper or the like. The fibrous webs can be made from natural fibers (including e.g. cellulosic fibers), synthetic fibers (e.g, polyethylene fibers) or a mixture of natural and synthetic fibers. Fibrous webs can employ typical fibers and/or "engineered fibers," such as those disclosed in U.S Pat. Nos. 6,127,036 and 5,759,394. These wicking fibers trap dirt inside microscopic channels engineered into the physical filter fibers. Fibrous webs, filter paper sheets, or any other relatively flexible substrate that contain filtration media particles, as described herein, can be folded, pleated, wound, or manipulated in any other manner to define a chemically active filter insert for incorporation into chemical filters of the present invention.

The particles can be formed primarily from a strong base material itself. By "strong base" is meant a base that will displace the weak base from the weak base-combustion acid complexes and return the weak base to the oil for recirculation to the piston ring zone where the weak base is reused to neutralize additional acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide ($Mg(OH)_2$), magnesium oxide (MgO), sodium aluminate ($NaAlO_2$), sodium carbonate ($Na_2CO_3$), sodium hydroxide (NaOH), zinc oxide (ZnO), zinc carbonate ($ZnCO_3$) and zinc hydroxide $Zn(OH)_2$ or their mixtures. Magnesium oxide and zinc oxide are preferred strong base materials, and one preferred mixture of strong base materials includes the combination of magnesium oxide and zinc oxide.

Figure 14:
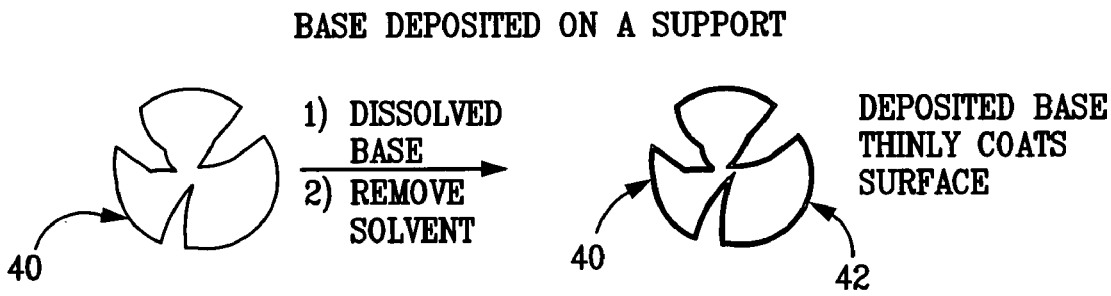
FIG. 14 is a schematic of a filtration media particle that includes a substrate particulate and a layer of a strong base material disposed thereon.

As noted above, the particles can alternatively be formed from a substrate material onto which a strong base material is disposed. The strong base may be incorporated on or with the substrate by methods known to those skilled in the art. For example, substrate particles can be exposed to a solution of dissolved strong base material and a solvent so that the solution coats the exterior and interior surface areas of the particles. The solvent is then removed, leaving a thin layer of strong base material disposed on the substrate particles. FIG. 14 is a simplified schematic illustrating this process, wherein a substrate particle 40 is coated with a thin layer of a strong base material 42. Suitable substrates 40 include, but are not limited to, activated carbon, carbon black, activated or transition alumina, silica gel, aluminosilicates, layered double hydroxides, micelle templated silicates and aluminosilicates, manganese oxide, mesoporous molecular sieves, MCM-type materials, diatomaceous earth or silicas, green sand, activated magnesite, adsorbent resins, porous clays, montmorillonite, bentonite, magnesium silicate, zirconium oxide, Fuller's earth, cement binder, aerogels, xerogels, cryogels, metal-organic frameworks, isoreticular metal-organic frameworks, and mixtures thereof. Activated carbon has been found to be a preferred substrate on which to deposit a very thin or monolayer of a strong base material. For this purpose it is useful (although not required) that the carbon surface is acidic. In accordance with the preferred embodiments, having a strong base material "associated" with particulate filtration media includes embodiments where the particles are primarily made from the strong base material itself, as well as embodiments where the strong base material is disposed onto substrate particles (which material itself may or may not contribute to the strong base functionality).

It should be noted that many of the above-listed substrates are physically active materials, and that alternative chemical filter and/or insert embodiments of the present invention employ mixed filtration media—both chemically and physically active filtration media. For example, a volume of activated carbon can be employed in a chemical filter, and only a portion of the carbon particles be coated with a strong base material. The uncoated carbon particles would serve as physically active filtration media capable of adsorbing any number of oil contaminants, and the coated particles serve as chemically active filtration media capable of immobilizing combustion acids and recycling lubricant dispersants in accordance with the invention. The mixed filtration media can be formed into a single solid structure with binder material. Alternately, the physically active particles could be bound into a first insert or component and the chemically active particles bound into a second insert or component, with the two components assembled within a chemical filter housing.

The amount of strong base material required will vary with the amount of weak base in the oil and the amount of acids formed during engine operation. However, since the strong base material is not being continuously regenerated for reuse as is the weak base material, the amount of strong base material is preferably at least equal to ⅓ the equivalent weight of the weak base in the oil, and more preferably two or more times the weight of the weak base employed in the oil.

The exchange between strong base and weak base is a surface phenomenon. Molecules of strong base that are not located at an accessible surface are therefore unavailable for exchange with a weak base. A particle of strong base that is non-porous, i.e. with only exterior surface area, would have little surface area and would likely be inefficient for exchange with a weak base. Only those molecules at the surface would be available for exchange and all non-surface molecules of strong base would be unusable. Porous filtration media particles—those having internal pores—accordingly are preferred. As the porosity of a particle increases, the total surface area, i.e. the exterior plus interior surface area (as defined by internal pores), greatly increases. At some measure of porosity the exterior surface area becomes inconsequential. For particles of optimum porosity, where the exterior surface area is inconsequential, the particle size is best chosen for considerations of minimizing pressure drop through the filter and for ensuring the structural integrity of the filter bed. The particles preferably range from about 50 nanometers to about 25 micrometers. If the particles have an effective diameter that is less than about 5 micrometers, then it is generally preferred that the particles be bound into aggregate particles or into a solid structure because the inactive size-exclusion filter members required to immobilize smaller particles would impose a large pressure drop across the filter, and it is desirable to contain the particles within the chemical filters of the present invention.

Not all interior surface area is available for immobilizing combustion acids. It is necessary that the combustion acid-weak base complex be able to enter into the internal pore to access the interior surface area that includes a strong base material. When contact with the strong base occurs, the combustion acid-weak base complex ion exchanges with the strong base, the combustion acid remains immobilized on the surface, and the regenerated weak base returns to solution. Maximizing usable surface area maximizes the capacity of the strong base material. Thus, a limitation to complete surface utilization is that of size exclusion of the weak base-combustion acid complex by a small pore or small pore entrance. Namely, the weak base must fit into the pore or through a size-restrictive pore entrance. As a result, the weak base-combustion acid complex solution phase diameter of gyration determines the smallest functional pores. The radius (or diameter/2) of gyration of an object is the radius of a thin-walled hollow cylinder that has the same mass and the same moment of inertia as the object in question.

One widely used dispersant (weak base) is provided by condensation of polyisobutylene succinic anhydride and a branched poly(alkylene amine) ("PAM"). This dispersant can be considered as a short block copolymer with oleophilic PIB chains at the ends and a polar PAM segment in the middle. The solution phase diameter of gyration in a random walk configuration of this material has been estimated at 62 Angstroms (see Langmuir 2005, 21, 924-32, "Effect of Temperature on Carbon-Black Agglomerates in Hydrocarbon Liquid With Adsorbed Dispersant", You-Yeon Won, Steve P. Meeker, Veronique Trappe, and David Weitz, Department of Physics and DEAS, Harvard University; Nancy Z. Diggs and Jacob I. Emert, Infineum USA LP). Although not typically present in commercial formulations, trioctadecylamine also functions as a weak base. It could be added to a lubricant to serve this purpose. The solution phase diameter of gyration of this molecule may be estimated at 55 Angstroms by summing C—C and C—N bond lengths, and using the following information and calculation:

C—C bond length=1.54 Angstroms

C—N bond length=1.47 Angstroms $$2\times(17\times1.54\ \text{Å}+1.47\ \text{Å})=55\ \text{Å}$$

While these two weak bases are presented as examples, suitable weak bases with somewhat smaller diameters of gyration are possible, and filtration media having internal pores tailored for accepting these other weak bases is within the scope of the present invention. Although these calculations are based on the mean radius or diameter of rotation of the weak base, it is acknowledged that the mean radius or diameter of rotation of the weak base-combustion acid complex is slightly larger. However, since the combustion acid is complexed predominantly near the center of the weak base, the mean radius of rotation of the weak base and the weak base-combustion acid complex are not much different.

Figure 15:
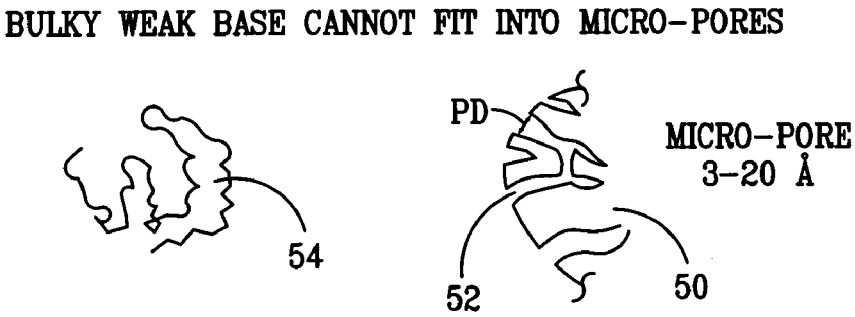
FIG. 15 illustrates relative size comparisons between typical weak base molecules and porous particles having micropores of an insufficient diameter to receive the weak base.

Although not bound by this theory, some believe that an internal pore diameter of less than 60 Angstroms will allow very few traditional weak bases to access the pore surface area because of size exclusion. FIG. 15 illustrates this scenario, where a porous particle 50 has internal pores 52 having a diameter PD that is much too small (<<60 Angstroms) to accept a bulky weak base molecule 54. An internal pore diameter of 80 Angstroms or greater is believed to allow a significant portion of the combustion acid-weak base complexes to access the interior surface of a pore. An internal pore diameter of 200 Angstroms or greater is believed to allow the vast majority of weak base-combustion acid complexes to access the interior surface of a pore. However, internal pores can become so large, that the structural integrity of the filtration media particles can become compromised. The upper limit of internal pore diameter varies with manufacturing techniques and applications. In some embodiments, the filtration media particles define filtration media pores (internal pores plus interstitial pores formed between adjacent particles) with a median pore diameter between about 60 Angstroms and about 3,000 Angstroms. It should be noted that pore diameters larger than 3,000 Angstroms are suitable for the present invention, so long as structural integrity may be maintained.

Filtration media particles of the present invention preferably provide a relatively large amount of available surface area for the weak base—strong base exchange; i.e., a surface area that is substantially derived from pores (internal pores defined within a particle and interstitial pores defined between adjacent particles) that are large enough to accept a combustion acid-weak base complex. In some embodiments, the filtration media has a surface area that is greater than or equal to about 25 $m^2$/gm derived from internal pores and interstitial pores that are capable of receiving a combustion acid-weak base complex (see, e.g., Magchem 30 brand magnesium oxide that is characterized in FIG. 27). In another embodiment, the filtration media has a surface area that is greater than or equal to about 30 $m^2$/gm derived from internal pores and interstitial pores that are capable of receiving a combustion acid-weak base complex (see, e.g., Premium brand magnesium oxide that is characterized in FIG. 27). In yet another embodiment, the filtration media has a surface area that is greater than or equal to about 50 $m^2$/gm derived from internal pores and interstitial pores that are capable of receiving a combustion acid-weak base complex (see, e.g., Magchem 40 brand magnesium oxide that is characterized in FIG. 27). A methodology for measuring the surface area in accordance with the above embodiments is mercury intrusion porosimetry. Mercury porosimetry utilizes the Washburn equation to calculate pore size information from measured pressures. The volume is calculated by converting measured capacitance to volume. The data reported generally includes total pore area, bulk density, skeletal density, porosity, average pore diameter, median pore diameter, and total intrusion volume.

In some embodiments, morphology of the filtration media employed in chemical filters of the present invention is important. Some strong bases, for example, limestone and several forms of magnesium and zinc oxide, have very few internal pores and thus very low surface area (see FIGS. 24-27).

Figure 16:
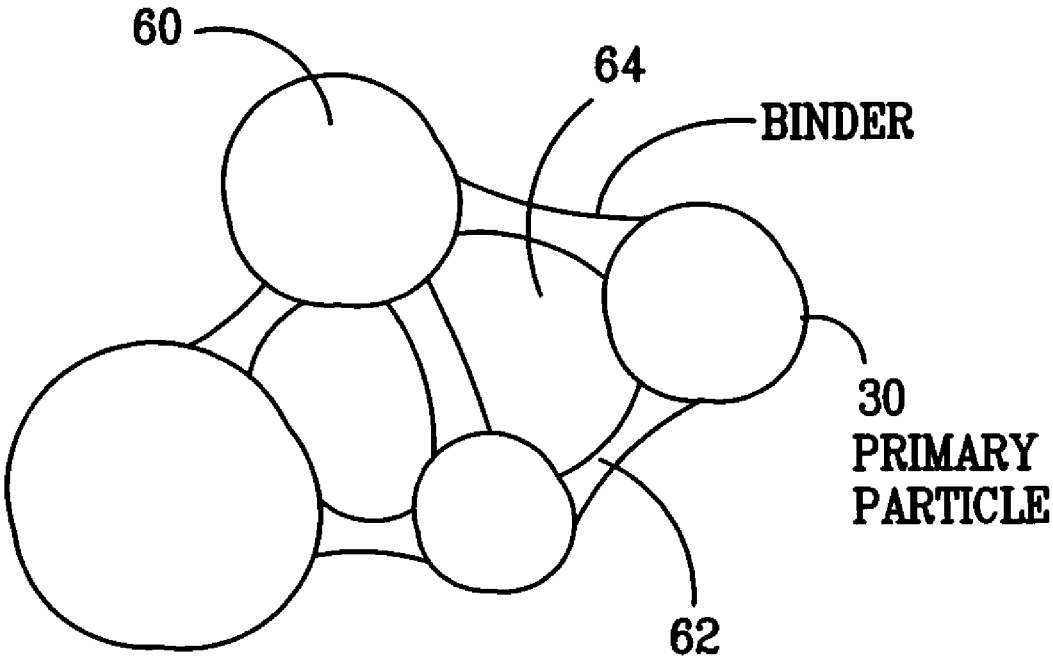
FIG. 16 is a schematic of a portion of filtration media including particles (having an associated strong base material) and binder material that may form a substantially continuous binder matrix and that spans and binds adjacent particles.

Filtration media particles are preferably bound together with a binder material as is shown in FIG. 16. In one embodiment, the filtration particles and binder material are formed into monolithic structures. One reason for this is to prevent settling of primary filtration media particles that can result in channeling of lubricant flowing through the filtration media. Another reason for binding the particles is due to their size. Many strong base particles are smaller than 5 microns (effective diameter), and could potentially enter the lubrication stream since even traditional by-pass inactive size-exclusion filter members have about a 5 micron limitation. FIG. 16 shows primary particles 60 bound with binder 62. Importantly, binder 62 does not completely fill the spaces created between adjacent particles 60 because interstitial pores 64 are required for diffusion of oil through the filtration media. Binder material 62 may be discreet strands or particles which span and bind adjacent chemical filter particles 60 or form a substantially continuous porous binder matrix that encloses and binds adjacent chemical filter particles 60.

Useful binders include, but are not limited to, polyolefins, polyvinyls, polyvinyl esters, polyvinyl ethers, polyvinyl sulfates, polyvinyl phosphates, polyvinyl amines, polyoxidiazoles, polytriazols, polycarbodiimides, polysulfones, polycarbonates, polyamides, polyethers, polyarylene oxides, polyesters, polyvinyl alcohols, polyacrylates, polyphosphazenes, polyurethanes, polyethylenes, polypropylenes, polybutene-1, poly-4-methylpentene-1, poly-p-phenylene-2, 6-benzobisoxazole, poly-2,6-diimidazo pyridinylene-1,4 (2,5-dihydroxy)phenylene, polyvinyl chlorides, polyvinyl fluorides, polyvinylidene chlorides, polyvinyl acetates, polyvinyl proprionates polyvinyl pyrrolidones, polysulfones, polycarbonates, polyethylene oxides, polymethylene oxides, polypropylene oxides, polyarylates, polyethylene terephthalate, polypara-phenyleneterephthalamide, polytetrafluoroethylene, ethylene-vinyl acetate copolymers, polyurethanes, polyimides, polybenzazoles, para-Aramid fibers, polymer colloids, latexes, and mixtures thereof. Preferred binders are selected from the group comprising low density polyethylene, high density polyethylene, ethylene-vinyl acetate copolymer, nylon, and mixtures thereof. Nylon is an especially preferred binder, with Nylon 11 (available from Arkema as Rilsan® polyamide 11) being most preferred.

The binder may also be a thermoset material. Preferred thermoset binders include phenolformaldehyde resin and melamine resin. Inorganic binder materials are also contemplated by the present invention. A representative, non-limiting list of inorganic binders includes silica, alumina, aluminates, silicates, reactive oxides, aluminosilicates, metal powders, volcanic glass and clays. Particularly preferred clays are kaolin clay, meta-kaolin clay, attapulgus clay, and dolomite clay. In one embodiment, filtration media particles are immobilized within a monolithic structure created by the addition of a polymeric organic binder and an inorganic binder.

The binder materials and the filtration media particles (strong base powder or substrate powder having a strong base material disposed thereon) can be combined using various techniques known by one skilled in the art. Two techniques suitable for combining the binder materials and the filtration media particles are disclosed in U.S. Pat. Nos. 5,019,311 and 5,928,588, both of which are incorporated in their entirety herein by reference. These patents also disclose other suitable binder materials that can be employed with filtration media particles of the present invention.

Figure 17:
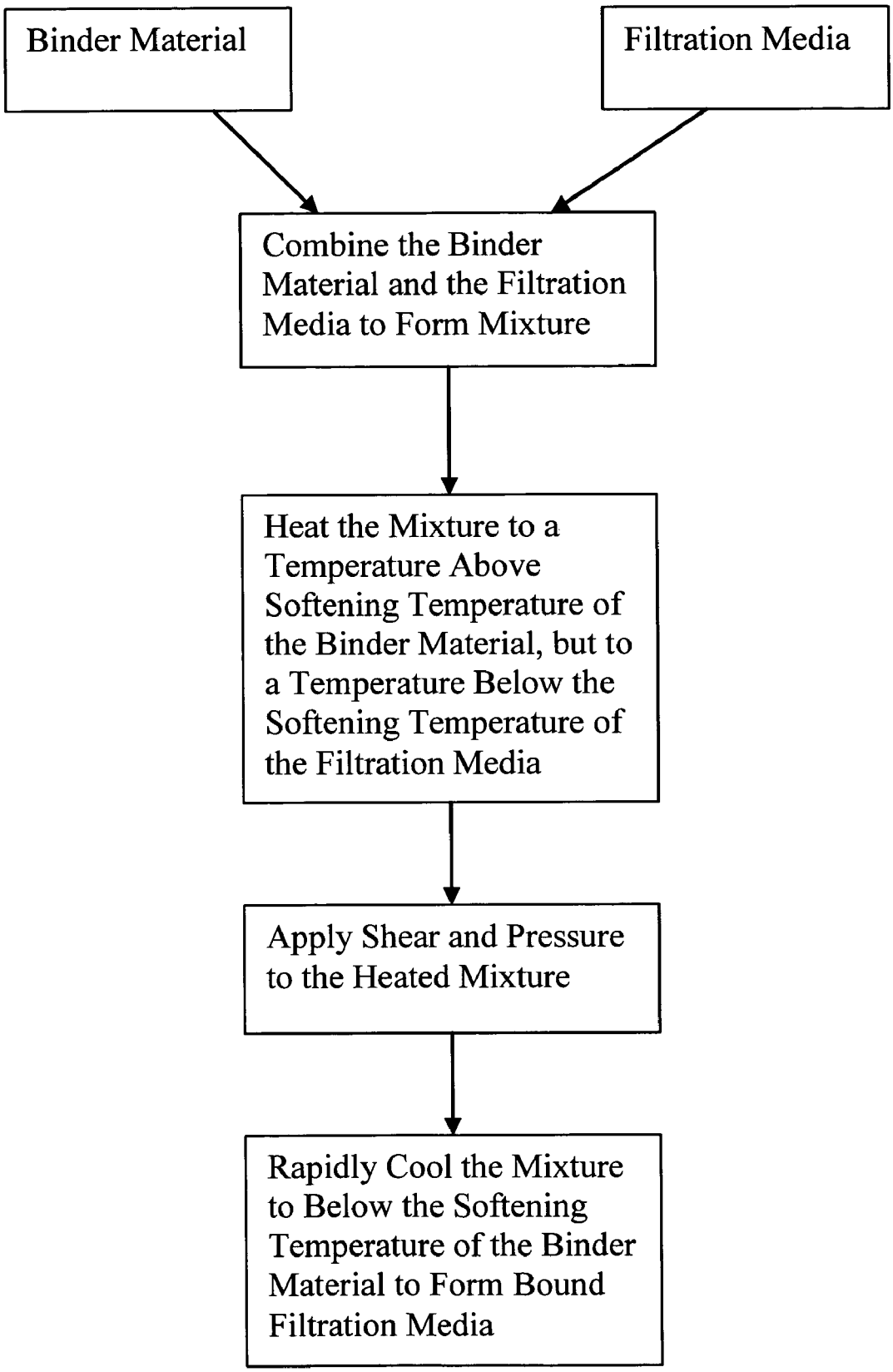
FIG. 17 is a diagrammatic showing a first method for making bound filtration media in accordance with the present invention.
Figure 18:
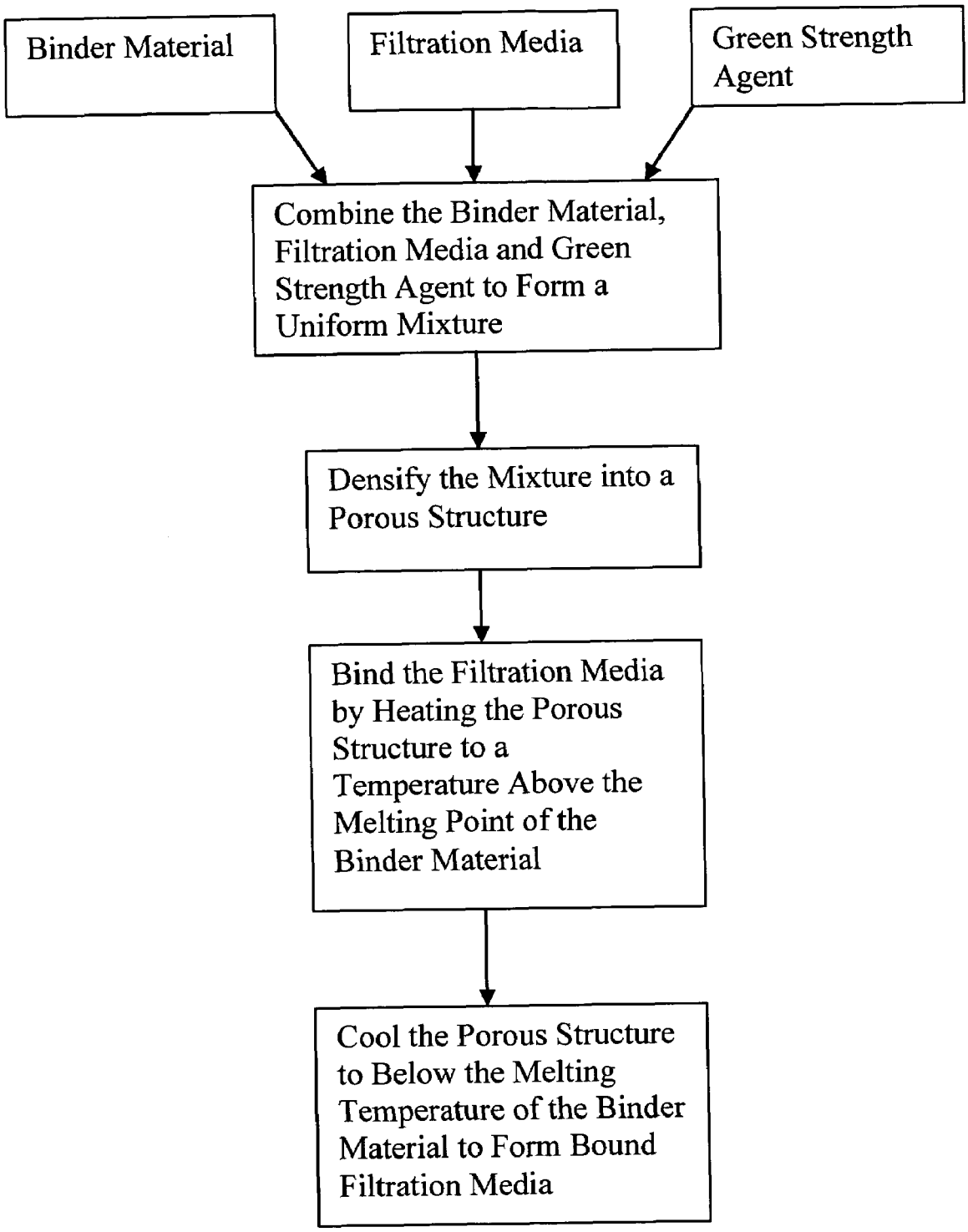
FIG. 18 is a diagrammatic depicting a second method for making bound filtration media in accordance with the present invention.
Figure 19:
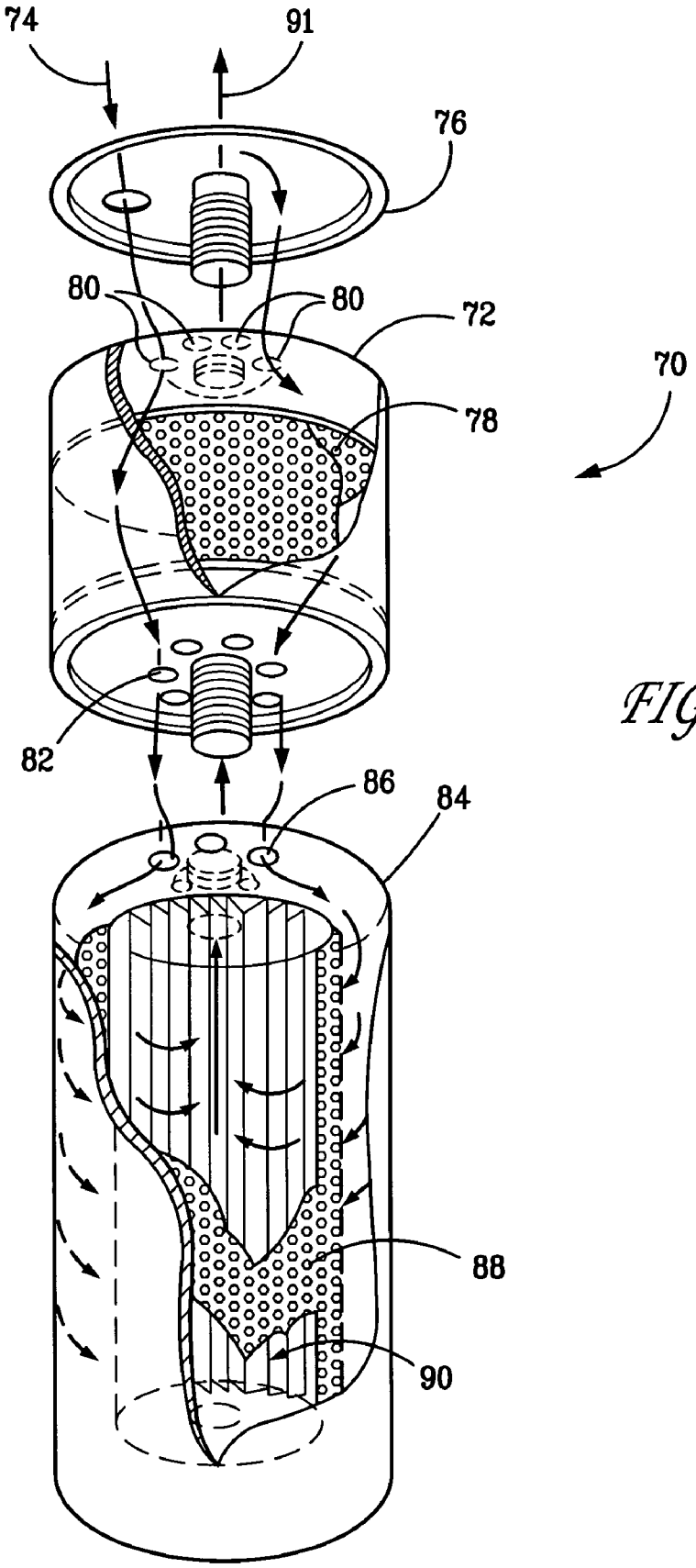
FIG. 19 is perspective view of a two-stage chemical filter in accordance with an embodiment of the present invention.

Two preferred methods for making bound filtration media are shown in FIGS. 17 and 18. A first method, shown in FIG. 17, includes combining filtration media and binder material to form a mixture. The mixture is heated to a temperature that is above the softening temperature of the binder material, but is below the softening temperature of the filtration media. Shear and pressure are applied to the heated mixture. In one embodiment, a sufficient amount of shear and pressure are applied to convert at least some of the binder material into a substantially continuous webbing structure. The filtration media particles and binder material can be selected from the above discussion of suitable materials.

The method illustrated in FIG. 18 includes combining filtration media binder material, and a green strength agent into a substantially uniform mixture. The mixture is then densified into a porous structure. The porous structure is heated to a temperature above the melting point of the binder material, resulting in the binder material flowing and contacting adjacent filtration media particles. The porous structure is then rapidly cooled to a temperature below the melting point of the binder material. The filtration media particles and binder material can be selected from the above discussion of suitable materials. The green strength agent can be in the form of a powder, fibers, liquids, or mixtures thereof. A representative list of suitable fibers includes fibrillated or micro-fibers selected from the group consisting of polyolefin fibers, polyesters, nylons, aramids, and rayons. Suitable liquids include, but are not limited to, latexes and resin solutions.

Agglomerations (e.g., in the form of a "pellet") of primary particles and binder material can be made, and the agglomerations contained within a chemical filter through various means, such as a mesh cage or liquid permeable fibrous mat (e.g., filter paper, a woven fibrous web, or a nonwoven web). Chemically active filter members to be inserted into a chemical filter can be formed into solid, porous structures using various techniques, including the methods; shown and described with reference to FIGS. 17 and 18, as well as those disclosed in the U.S. Pat. Nos. 5,019,311 and 5,928,588.

One preferred porous structure, which can be made with the above-disclosed methods, includes filtration media particles, including but not limited to those described above, and a matrix of thermoplastic binder supporting and enmeshing the filtration media particles. The matrix of thermoplastic binder is preferably a substantially continuous thermoplastic binder phase that supports and enmeshes the filtration media particles. The substantially continuous thermoplastic binder phase is preferably formed from binder materials that are substantially incapable of fibrillation under normal conditions (i.e., ambient conditions known to those skilled in the art) into micro fibers having a diameter of less than about 10 micrometers and that have a softening temperature substantially below that of the filtration media particles. The filtration media particles may be consolidated into a uniform matrix within the substantially continuous thermoplastic binder phase that is present as a dilute material within interstitial pores between the filtration media particles. The remainder of the pore volume includes a continuous volume of voids and the binder material being forced into macropores and exterior voids of individual filtration media particles.

Another preferred porous structure, which can be made with the above-disclosed methods, includes filtration media particles, including but not limited to those described above, a component providing binding capability, and a component providing green strength reinforcement capability. The component providing binding capability can include any of the binder materials disclosed herein, and is preferably selected from the group comprising a thermoplastic, a thermosetting polymer, an inorganic binder, and mixtures thereof. An exemplary embodiment includes from about 70 to about 90 weight percent of filtration media particles, from about 3 to about 20 weight percent of the component providing binding capability, and from about 1 to about 15 weight percent of the component providing green strength reinforcement capability. The porous structure may optionally include a component selected from the group comprising a cationic charged resin, an ion-exchange material, perlite, diatomaceous earth, activated alumina, zeolites, resin solutions, latexes, metallic materials and fibers, cellulose, carbon particles, carbon fibers, rayon fibers, nylon fibers, polypropylene fibers, polyester fibers, glass fibers, steel fibers, graphite fibers, and mixtures thereof.

The solid, porous structures can have numerous configurations and dimensions, with one preferred structure being a cylinder that can be placed radially inward or outward from an inactive size-exclusion filter member housed within a filter canister, resulting in a chemical filter of the present invention. The structures can be formed into a first configuration and then manipulated into a second geometry prior to incorporation into a chemical filter canister or other housing. For example, a solid, porous sheet can be formed that includes particles and binder material, and the sheet then formed into a cylinder or spirally wound to define multiple radially disposed layers.

The preferred placement of chemical filters of the present invention is the location of traditional oil filters (full-flow and/or by-pass) of an internal combustion engine lubrication system. Other locations within a lubrication system are contemplated by the present invention. With the preferred placement, the traditional filters are replaced or combined with the chemical filters of the present invention. Obviously, with the preferred placement, an inactive size-exclusion filter member is required along with the chemically active filtration media comprising a strong base material as described above. The chemically active filtration media may be oriented within a chemical filter canister or other housing in several ways. It may be placed upstream of the inactive size-exclusion filter member wherein any fines released by the chemically active filtration media would be isolated by size exclusion filtration. It may be placed downstream of the inactive size-exclusion filter member wherein particles are first removed by the size-exclusion filter before any pores in the chemically active filtration media are obstructed by suspended particles. It may also be placed before and after the inactive size-exclusion filter. A single filter member may also be defined that acts as both a size-exclusion filter and a chemically active filter. For example, a chemically active filtration media can be engaged with a filter paper sheet, and the sheet wound around a central mandrel to give alternating layers of chemical filter and size-exclusion filter as outlined in U.S. Pat. Nos. 5,792,513; 6,077,588; 6,355,330; 6,485,813; or 6,719,869. In addition to a backing sheet, a cover sheet may be utilized as well. Flow of the lubricant through chemical filters of the present invention may have various flow patterns, including radial and axial.

As discussed above, FIG. 11 is one exemplary chemical filter provided by the present invention. The skilled artisan would generally characterize chemical filter 10 as a chemical single stage filter. Alternative chemical filters of the present invention may define or be incorporated into multiple stage filtration. By way of example and with reference to FIG. 19, another exemplary chemical filter 70 is shown in the configuration of a chemical two-stage filter. Oil initially flows into a first stage 72 through an opening 74 disposed in cover 76. Oil is then distributed to filtration media 78 via inlets 80. Filtration media 78 preferably comprises the chemical filtration media (with strong base) described throughout the remainder of the specification. Oil exits first stage 72 through outlets 82 and into a second stage 84 via inlets 86. Second stage 84 includes an annular arrangement of filtration media 88 surrounding an inactive size-exclusion filter member 90. Filtration media 88 preferably includes a strong base material and may be physically and chemically similar or dissimilar to filtration media 78. By way of example only, filtration media 78 can include zinc oxide while filtration media 88 includes magnesium oxide. Oil flows radially inward through filtration media 88, through inactive size-exclusion filter member 90, and then exits the second stage via a central exit 91.

Figure 20:
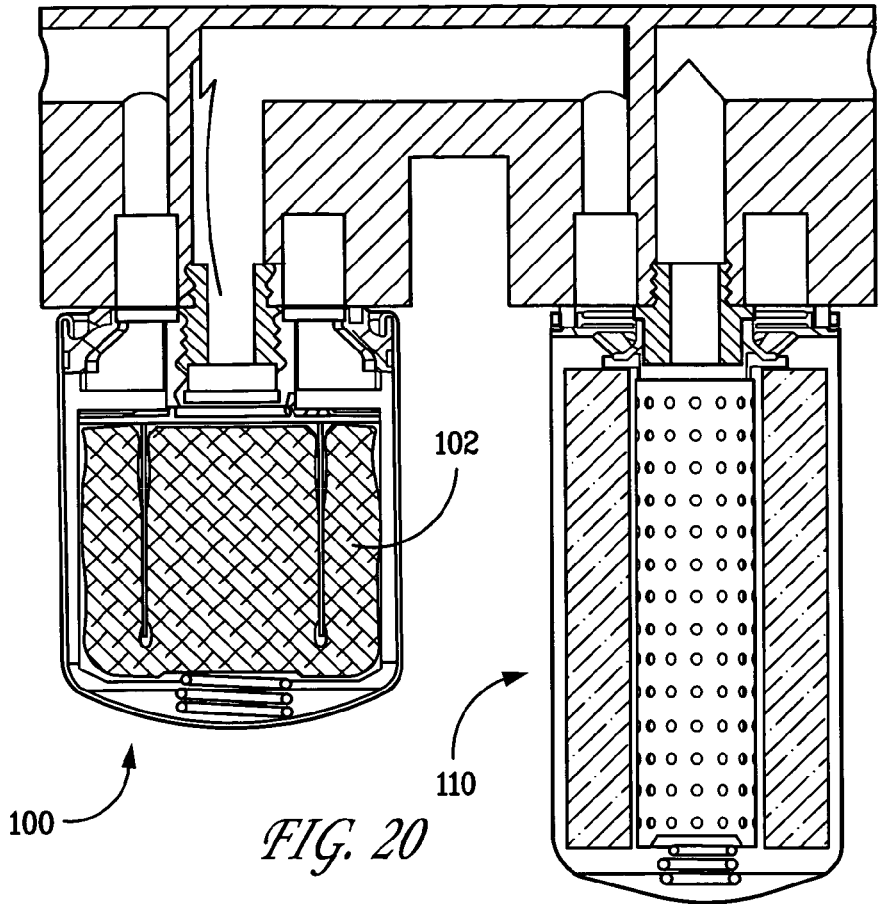
FIG. 20 is a cross-sectional view of a portion of a lubrication system for an internal combustion engine, the lubrication system including a chemical filter and a traditional inactive size-exclusion filter member that is spaced apart from the chemical filter.

As illustrated in FIG. 20, a chemical filter 100 can be placed in the lubrication system for an internal combustion engine, whereby oil is circulated serially through both an inactive size-exclusion filter, for example, filter 110, and a chemical filter 100. Oil can flow through either filter first. Chemical filter 100 contains chemically active filtration media 102 that includes a strong base material in accordance with the description herein.

Figure 21:
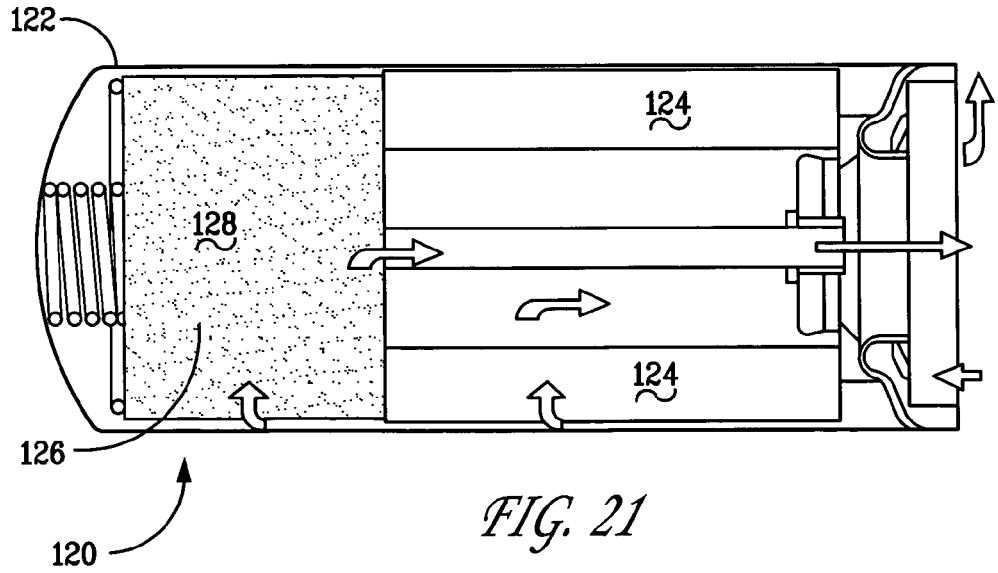
FIG. 21 is a cross-sectional view of an exemplary chemical filter of the present invention, the chemical filter including an inactive size-exclusion filter member arranged end-to-end with a chemically active filter member or insert that operates in a by-pass mode.

In alternate chemical filter embodiments of the present invention, chemically active filter members can be arranged substantially end-to-end with an inactive size-exclusion filter member, in contrast to the radial placement that is shown in FIG. 11. With reference to FIG. 21, an exemplary chemical filter 120 is shown including a housing 122, an inactive size-exclusion filter member 124 disposed in housing 122, and a chemical filter member 126 disposed at one end of inactive size-exclusion filter member 124. Chemical filter member 126 includes filtration media 128 having an associated strong base material. This embodiment may or may not include a Venturi nozzle.

With an end-to-end arrangement, a complete full flow scenario can be realized whereby all of the oil flows through the inactive size-exclusion filter member 124 and the chemically active filter member 126. Alternatively, a variety of by-pass flow scenarios can be accomplished so that a portion of incoming oil flows only through one or more inactive size-exclusion filter members, and the remaining portion flows through the chemically active filter member. In other embodiments, a first portion of the incoming oil flows through only the chemically active filter member, a second portion of the incoming oil flows through only the inactive size-exclusion filter member, and a third portion of the incoming oil flows through both filter members. The chemical filter and its overall configuration are not critical to the present invention.

In the embodiments that seek to create high surface area, it can be effective to generate very small substantially solid non-porous particles of a strong base material. The particles would preferably be in the nanometer size range. These nanometer-sized particles could be agglomerated using a binder or adhesive to form a porous (defined by interstitial pores between adjacent particles) solid. This structure provides a high surface area filtration component. The structure would likely have little or no internal surface area until the particles were coalesced, but after would be suitable for the application described and disclosed herein. The nanometer-sized strong base particles could also be dispersed and/or adsorbed onto a suitable porous substrate (as described above).

For example, spherical particles of magnesium oxide that have a diameter of one nanometer would have an approximate external surface area of 280 $m^2$/gm. Those having a diameter of five nanometers would have an approximate external surface area of 56 $m^2$/gm. If the geometries were non-spherical and irregular, the surface areas could be considerably higher. Spherical particles of zinc oxide that have a diameter of 1 nanometer would have an approximate external surface area of 178 $m^2$/gm and those having a diameter of 5 nanometers would have an approximate external surface area of 36 $m^2$/gm. Again, if the geometries were non-spherical and irregular, the surface areas could be considerably higher.

In order to reduce emissions, engine manufacturers have begun employing a technology known as Exhaust Gas Recirculation ("EGR"). This technology recycles exhaust back into the combustion chamber. A schematic of the main components of an EGR system is depicted in prior art FIG. 22. One portion 130 of the exhaust exits the vehicle as it normally would, while another portion 132 of the exhaust is routed through an EGR valve 134. Recovered exhaust gases 132 are then cooled with an oil cooler 136, for example, before being combined with clean air 138 introduced at the air/fuel mixture intake 140. This combination air/fuel mixture is delivered to a combustion chamber 142.

Figure 22:
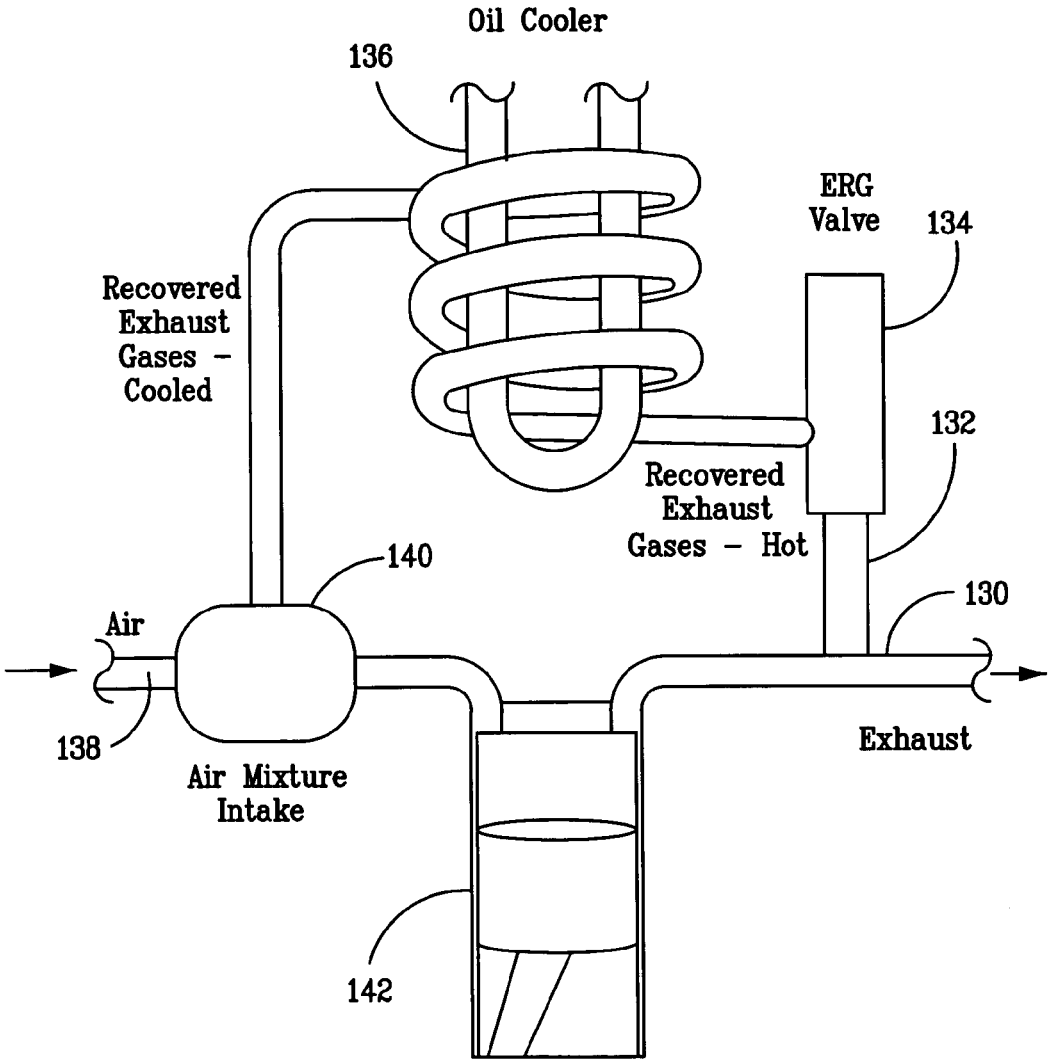
Prior Art FIG. 22
FIG. 22 is a schematic of an exhaust gas recirculation system that is known in the art.
Figure 23:
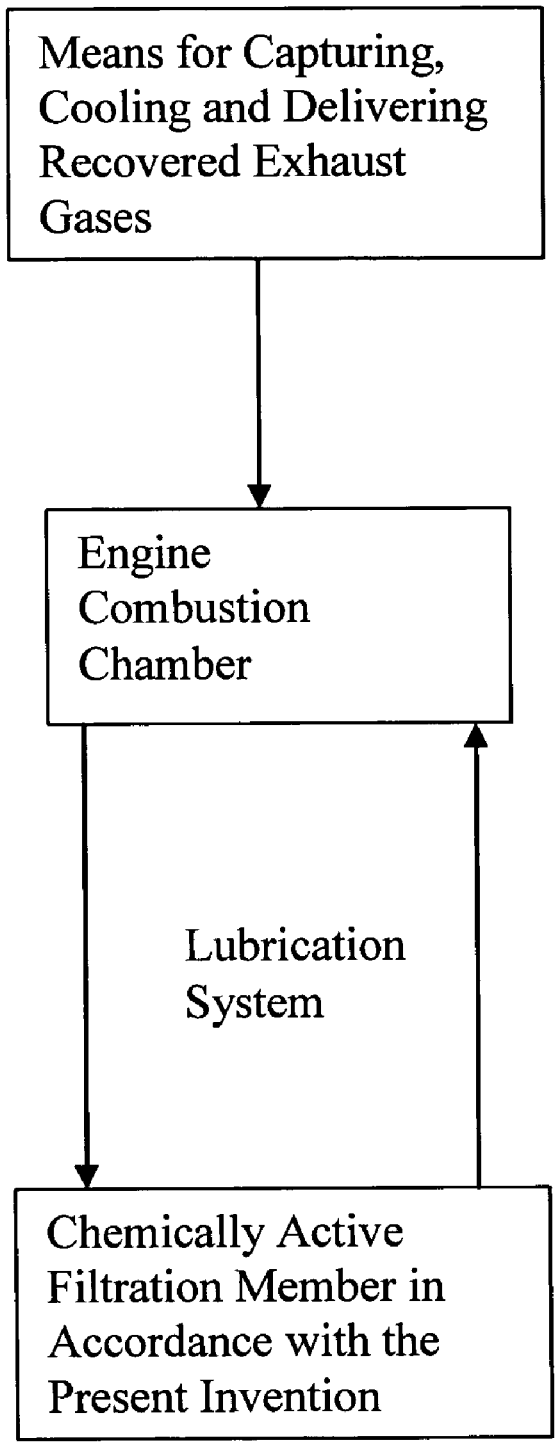
FIG. 23 is a diagrammatic depicting a system embodiment for controlling combustion by-products in accordance with the present invention.

Chemical filters of the present invention are particularly useful for vehicles incorporating EGR technology. Accordingly, systems for controlling combustion by-products are provided by the present invention. FIG. 23 is a diagrammatic of one preferred system embodiment. The means for introducing recovered exhaust gas into the combustion chamber can be any of those known to one skilled in the art, including the conduits, EGR valve and oil cooling components that are shown in FIG. 22. The chemically active filtration member included in this embodiment includes filtration media having internal pores with a median pore diameter that is at least about 60 Angstroms, and a surface area greater than or equal to about 25 $m^2$/gm.

CHEMICAL FILTER EXAMPLES

Several candidate strong base materials were investigated for suitable application in chemical filters of the present invention. Gas adsorption and mercury porosimetry methodologies were utilized to characterize the porosity and surface area characteristics of the candidate materials, as described below.

Sample Preparation

In order to ensure that all porosity is accurately accounted and measured, formed, bound, or solid materials must be ground into a fine powder whose particle size is that of the primary particles before running the pore analysis. To determine whether or not the transformed material is sufficiently ground prior to assessing its porosity, electronic micrograph results of the ground material can be compared to the porosimetry results. The transformed material is sufficiently ground when the electron micrograph results indicate pores sizes substantially equivalent to the pore sizes measured via porosimetry techniques. This sample preparation is intended to prevent ink bottle, shielding, and skin effects commonly associated with the interstitial pores of such materials. The analysis is preferably conducted on the chemical filtration material prior to the addition of binders (i.e., the chemical filtration material as supplied by the manufacturer).

Mercury Intrusion Porosimetry

Pore size distribution was determined by Micromeritics Analytical Services of Norcross, Georgia using mercury intrusion porosimetry. Void volume and the corresponding pressure (or pore size) was recorded utilizing a Micromeritics Autopore IV 9520 instrument. Mercury intrusion data were then analyzed to determine pore volume distribution of pores between 330 and 0.003 micrometers in diameter. Mercury porosimetry utilizes the Washburn equation to calculate pore size information from the pressure measured. The volume is calculated by converting measured capacitance to volume. The data reported includes total pore area, bulk density, skeletal density, porosity, average pore diameter, median pore diameter, and total intrusion volume.

The porosity and surface area characteristics of the candidate strong base materials are shown in FIGS. 24-27. FIG. 24 includes porosity calculations of prior art material Catalyst 75-1, as described above. FIG. 25 includes unsuitable magnesium oxide and zinc oxide candidate materials; FIG. 26 includes limestone materials believed unsuitable for this application. The strong base materials in FIGS. 25 and 26 have such a low reported total surface area, that even if all of the surface area was derived from pores sized adequately for accepting combustion acid-weak base complexes, the strong base materials would likely be ineffective for increasing the time between oil drains.

FIG. 27 includes a representative, non-limiting list of suitable and preferred strong base materials in accordance with the present invention. The usable surface (for this application) of the materials included in FIG. 27 ranges from a value that is equal to or greater than about 25 $m^2$/gm (26-27 $m^2$/gm for Magchem 30) to a value that is equal to or greater than about 50 $m^2$/gm (50-61 $m^2$/gm for MagOx 98 HR). Several candidate materials have usable surface area values in the 30's ($m^2$/gm). Magchem 50 (MgO), available from Martin Marietta, is a particularly preferred strong base material.

In addition to the discussion in the Background Section regarding Catalyst 75-1, the table in FIG. 27 illustrates that the BET surface area, which is a surface area value commonly reported by suppliers, is not necessarily indicative of how much usable surface area (for this application) a particular strong base material provides. For example, the manufacturer of Magchem HSA 30 reports that the material has a BET surface area of 160 $m^2$/gm. However, much less than half of the BET surface area is derived from pores that are large enough to accept a combustion acid-weak base complex (62 $m^2$/gm usable surface area derived from pores 1066 to 60 Å), an approximate surface area range necessary for immobilizing combustion acids. Further, nearly half of the remaining usable surface area (62 $m^2$/gm ) of HSA 30 resides in pores with relatively small openings in the size range of 60 to 80 Å. Since there is typically variability in the weak base molecular weight (and thus the solution phase diameter of gyration), molecules that fall into the large end of the distribution may only fit into pores greater than 80 Å. Thus, the functional surface area of a seemingly highly effective material like HSA 30 actually approaches a more modest 32 $m^2$/gm. This derives from the fact that this material has a median pore diameter of 55 Å. In contrast, a material like Magchem 50 has a much lower BET surface area (65 $m^2$/gm reported by the manufacturer), but nearly all of the surface area resides within pores that are accessible to even large combustion acid-weak base complexes (64 $m^2$/gm usable surface area derived from pores 1066 to 80 Å). This derives from the material's much larger median pore diameter of 141 Å. In addition, these larger pores aid rapid through-particle diffusion, essential for efficient immobilization of combustion acids.

Pore volumes of the materials shown in FIG. 27 range from 0.8 to 1.4 ml/gm. However, the value for acceptable materials can vary considerably depending upon the material's particle size distribution and in particular, can be quite smaller than the low end of this range. This derives from the fact that in materials with broad size distributions, the smaller diameter particles occupy interstitial spaces formed by the larger particles and lead to a much reduced pore volume. If a binder is added, this additional material may occupy interstitial spaces and/or block available porosity and thus reduce overall pore volume. In contrast, low density strong base materials, such as those that occur in aerogels, xerogels, and cryogels, may have pore volumes that are considerably higher than this range. Thus, candidate materials may have a total intrusion volume that is greater than 0.3 ml/gm. Also with reference to FIG. 27, the preferred candidate materials have a median pore diameter of from about 55 Angstroms to about 350 Angstroms.

The Relationship between Filter Immobilized Strong Base, Lubricant Detergent Concentration, and Oil Drain Interval.

Approximate Strong Base Neutralization Capacity. The capacity of strong base in a chemical oil filter to immobilize acid relates directly to the strong base surface area accessible to the acid. As described in U.S. patent application Ser. No. 11/133,530, a strong base suitable for use in this invention is Magchem 50 with a surface area accessible to a dispersant-acid complex equal to 68 meters squared per gram of MgO. By estimation, one molecule of combustion acid occupies an area approximately 3 Å by 3 Å. Thus, 100 grams of Magchem 50 has an accessible surface area of $6.8\times10^{23}$ $Å^2$. Dividing this value by 3 Å×3 Å and by Avogadro's number of $6.02\times10^{23}$ indicates that 100 grams of Magchem 50 will immobilize about 0.13 moles of acid in a chemical oil filter. Normally dispersant is sold as a 50 weight percent concentrate. This concentrate contains about 0.009 moles of dispersant per 100 grams of concentrate and common dispersant treat rates range from 3.5 to 5.0%. Assuming a 4.5% treat rate, a 10 gallon oil charge in a diesel engine would contain 0.14 moles of dispersant. So, 100 grams of MgO immobilizes 0.13 moles of acid and the normal dispersant treat neutralizes 0.14 moles of acid. In other words, 100 grams of Magchem 50 can immobilize approximately as much acid as a normal dispersant treat assuming that one mole of dispersant neutralizes one mole of acid.

By extension, 400 grams of MgO immobilizes four times as much acid as one normal dispersant treat and 1,000 grams of MgO immobilizes nine times as much acid as one normal oil treat. Thus, a chemical oil filter containing 400 grams of Magchem 50 recycles the dispersant four times and immobilizes five times as much acid as the dispersant normally neutralizes. Namely, once the MgO surface fills with acid, the dispersant then neutralizes one more acid equivalent. In effect, a lubrication system with 400 grams of Magchem 50 in the filter and a normal dispersant treat can neutralize five times as much acid as the normal dispersant treat can do on its own. The difference is that 80% of that acid is immobilized away from the lubricant where it cannot adhere to metal surfaces and add to varnish and piston deposits.

Oil Drain Intervals, TBN and Detergent Concentration. A Total Base Number (TBN) lower limit commonly determines engine oil drain intervals. The operator performs an oil analysis and changes the oil when it indicates a critically low TBN level, typically two to five. As indicated above, a strong base in a chemical oil filter neutralizes acid by recycling dispersant and thus maintains a lubricant's TBN. The capacity of the strong base can therefore be used to either extend oil drain intervals or to reduce the detergent level in a modified lubricant or a combination of both. Reducing the detergent level in the lubricant has the advantage of reducing piston deposits and of reducing deposits on a particulate filter used in an engine's after-treatment system.

While the above estimations consider three levels of MgO in a chemical oil filter (100, 400 and 1,000 grams), there is an obvious advantage to having as much strong base in the filter as feasible. Considerations influencing how much strong base may be placed into a filter include the maximum allowable filter volume and the pressure drop across the filter. Given these constraints, other chemical agents placed in the filter (an anti-wear additive or an antioxidant) may necessitate a reduction in the amount of MgO. The examples below illustrate these relationships.

LUBRICATION SYSTEM EXAMPLES

System 1

A Lubrication System Comprising a Strong Base Chemical Filter, a Special Lubricant, and a Top-Up-Oil A lubricant system designed to maintain an adequate TBN in the used lubricant over a relatively consistent extended oil drain and to reduce piston deposits (which in part are derived from the ash in detergents) comprises a chemical filter, a lubricant and a top-up-oil equal to or different from the lubricant.

The chemical filter portion contains from about 100 to about 1,000 grams of a strong base.

The lubricant contains a metal based detergent giving rise to sulfated ash content ranging from 0 to about 0.8 weight percent and other additives known to those skilled in the art as being necessary to formulate a well balanced lubricant.

The top-up-oil contains a detergent level giving rise to a sulfated ash content ranging from 0 to about 0.8 weight percent, a level of dispersant from equal to about 3 times the level of dispersant in the lubricant, and other additives necessary to maintain the properties of the lubricant. This system is described in the following examples:

Chemical Filter

| Example | MgO (gms) |
|---|---|
| 1 | 100 |
| 2 | 200 |
| 3 | 400 |
| 4 | 800 |
| 5 | 1,000 |

Lubricant

| Example | Ca (ppm) | Zn (ppm) | N (wt %) | P (wt %) | Chemical Filter | Viscosity Modifier (wt %) | Sulfated Ash (wt %) | Ashless Antioxidant (wt %) |
|---|---|---|---|---|---|---|---|---|
| 1[a] | 3,896 | 1,649 | 0.13 | 0.15 | 1–5[c] | d | 1.6 | e |
| 2[a] | 2,749 | 1,271 | 0.18 | 0.13 | 1–5[c] | d | 1.2 | e |
| 3[b] | 2,500 | 1,270 | 0.19 | 0.12 | 1 | d | 1.1 | e |
| 4[b] | 2,200 | 1,270 | 0.2 | 0.12 | 2 | d | 1 | e |
| 5[b] | 1,880 | 1,270 | 0.21 | 0.12 | 3 | d | 0.9 | e |
| 6[b] | 1,130 | 1,270 | 0.25 | 0.12 | 4 | d | 0.66 | e |
| 7[b] | 0 | 1,270 | 0.3 | 0.12 | 5 | d | 0.3 | e |

Top-up-oil

| Example | Ca (ppm) | Zn (ppm) | N (wt %) | P (wt %) | Viscosity Modifier (wt %) | Sulfated Ash (wt %) | Ashless Antioxidant (wt %) |
|---|---|---|---|---|---|---|---|
| 1 | 2,500 | 1,270 | 0.19 | 0.12 | f | 1.1 | g |
| 2 | 1,250 | 1,270 | 0.4 | 0.12 | f | 0.7 | g |
| 3 | 0 | 1,270 | 0.3 | 0.12 | f | 0.3 | g |
| 4 | 0 | 1,270 | 0.4 | 0.12 | f | 0.3 | g |

[a]= Measured results on currently available commercial lubricants.
[b]= Ca, Zn, N and P values for this system and those following represent embodiments of this invention. Weight percent sulfated ash values are calculated assuming Ca as $CaSO_4$ and Zn as $ZnSO_4$.
[c]= Choose filter depending upon oil drain interval
d = As needed to meet viscosity targets.
e, g = As needed to meet anti-oxidation targets, typically about 0.5–2.0 weight percent.
f = 1 to 3 times the concentration in the lubricant, less if a shear stable viscosity modifier is used, more if a high molecular weight viscosity modifier is used.

1. Lubricant examples 1 & 2 represent currently available commercial lubricants.

2. Lubricant examples 3 through 7 and top-up-oil examples 1 through 4 are designed to reduce piston deposits for current and future engines.

3. Lubricant examples 4 through 7 and top-up-oil examples 2 through 4 are designed to meet and exceed the limits proposed for the "PC-10" of 0.12 wt % P and 1.00 wt % sulfated ash.

4. Lubricant examples 5 through 7 and top-up-oil examples 2 through 4 will produce fewer deposits on an emission filter than will those lubricants which just meet the proposed "PC-10" limits of 0.12 wt % P and 1.00 wt % sulfated ash.

5. Top-up examples 1 and 3 are the same as lubricant examples 3 & 7, respectively.

6. In general, the top-up-oil may have the same or a different formulation than the lubricant.

7. A comparison of lubricant example 4 to example 7 shows that removal of the detergent allows a reduction of sulfated ash by 70% while maintaining the level of phosphorus.

8. Sulfated Ash levels are determined by ASTM method D874 and elemental concentrations are determined by ASTM method D5185.

System 2

A Lubrication System Designed for use with Emission Control After-treatment Equipment Comprising a Strong Base Chemical Filter, a Slow Release ZnDDP, a Special Lubricant, and a Top-Up-Oil A lubricant system designed to maintain an adequate TBN in the used lubricant over an extended oil drain, to reduce piston deposits (which in part are derived from the ash in detergents), to reduce ash containing deposits on an emission filter, and to reduce poisoning of an emission catalyst comprises a chemical filter, a lubricant and a top-up-oil equal to or different from the lubricant.

The chemical filter portion contains from about 100 to about 950 grams of a strong base and from about 50 to about 600 grams of a controlled release rate anti-wear additive.

The lubricant portion contains a metal based detergent level giving rise to a sulfated ash content ranging from 0 to about 0.8 weight percent, a P content ranging from about 0.04 to about 0.11 weight percent, and other additives known to those skilled in the art as being necessary to formulate a well balanced lubricant.

The top-up-oil portion contains a detergent level giving rise to a sulfated ash content ranging from 0 to 0.8 weight percent, a P content ranging from about 0.04 to about 0.11 weight percent, a level of dispersant from equal to 3 times the level of dispersant in the lubricant, and other additives known by those skilled in the art to be necessary for the proper functioning of the lubricant. This system is described in the following examples:

Chemical Filter

| Example | MgO (gms) | Controlled Release ZnDDP (gms) |
|---|---|---|
| 1 | 950 | 50 |
| 2 | 800 | 200 |
| 3 | 600 | 400 |
| 4 | 550 | 50 |
| 5 | 200 | 400 |
| 6 | 100 | 600 |

Lubricant

| Example | Ca (ppm) | Zn (ppm) | N (wt %) | P (wt %) | Chemical Filter | Viscosity Modifier (wt %) | Sulfated Ash (wt %) | Ashless Antioxidant (wt %) |
|---|---|---|---|---|---|---|---|---|
| 1 | 1,800 | 1,200 | 0.21 | 0.11 | 1, 2 or 4 | a | 0.9 | b |
| 2 | 2,200 | 635 | 0.2 | 0.06 | 2, 3 or 5 | a | 0.9 | b |
| 3 | 1,600 | 635 | 0.23 | 0.06 | 2, 3 or 5 | a | 0.7 | b |
| 4 | 1,000 | 635 | 0.26 | 0.06 | 2, 3 or 5 | a | 0.5 | b |
| 5 | 0 | 425 | 0.3 | 0.04 | 1, 2 or 6 | a | 0.1 | b |

Top-up-oil

| Example | Ca (ppm) | Zn (ppm) | N (wt %) | P (wt %) | Viscosity Modifier (wt %) | Sulfated Ash (wt %) | Ashless Antioxidant (wt %) |
|---|---|---|---|---|---|---|---|
| 1 | 1,200 | 1,200 | 0.36 | 0.11 | c | 0.7 | d |
| 2 | 0 | 1,200 | 0.4 | 0.11 | c | 0.3 | d |
| 3 | 0 | 635 | 0.4 | 0.06 | c | 0.2 | d |
| 4 | 0 | 425 | 0.3 | 0.04 | c | 0.1 | d |
| 5 | 2,200 | 635 | 0.2 | 0.06 | c | 0.9 | d |

a = As needed to meet viscosity targets.
b, d = As needed to meet anti-oxidation targets, typically about 0.5–2.0 weight percent.
c = 1 to 3 times the concentration in the lubricant, less if a shear stable viscosity modifier is used, more if a high molecular weight viscosity modifier is used.

1. Lubricant examples 1 through 5 and top-up-oil examples 1 through 5 are designed to reduce piston deposits for current and future engines, to maintain TBN for an extended oil drain interval, and to reduce emission filter fouling and to reduce catalyst poisoning for those engines with emission after-treatment devices.

2. Top-up-oil examples 4 & 5 have the same formulation as lubricant examples 2 & 5.

3. In general the top-up-oil may have the same or different formulation as the lubricant.

System 3

A Lubrication System Comprising a Strong Base Chemical Filter, a Slow Release ZnDDP, an Anti-Oxidant, a Special Lubricant, and a Top-Up-Oil Designed for Use with Emission Control After-treatment Equipment A lubricant system designed to maintain an adequate TBN in the used lubricant over an extended oil drain, to reduce piston deposits (which in part are derived from the ash in detergents), to reduce ash containing deposits on an emission filter, and to reduce poisoning of an emission catalyst comprises a chemical filter, a lubricant and a top-up-oil equal to or different from the lubricant.

The chemical filter portion contains from about 100 to about 900 grams of a strong base, from about 0 to about 200 grams of a controlled release rate anti-wear additive and from about 50 to about 300 grams of an immobilized anti-oxidant.

The lubricant portion contains a metal based detergent level giving rise to a sulfated ash content ranging from 0 to about 0.8 weight percent, a P content ranging from about 0.04 to about 0.11 weight percent, and other additives known to those skilled in the art as being necessary to formulate a well balanced lubricant.

The top-up-oil portion contains a detergent level giving rise to a sulfated ash content ranging from 0 to 0.8 weight percent, a P content ranging from about 0.04 to about 0.11 weight percent, a level of dispersant from equal to 3 times the level of dispersant in the lubricant, and other additives known by those skilled in the art to be necessary for the proper functioning of the lubricant. This system is described in the following examples:

Chemical Filter

| Example | MgO (gms) | Controlled Release ZnDDP (gms) | Antioxidant[a] (gms) |
|---|---|---|---|
| 1 | 900 | 50 | 50 |
| 2 | 600 | 200 | 200 |
| 3 | 400 | 300 | 300 |
| 4 | 400 | 0 | 100 |
| 5 | 300 | 100 | 100 |
| 6 | 100 | 300 | 100 |

Lubricant

| Example | Ca (ppm) | Zn (ppm) | N (wt %) | P (wt %) | Chemical Filter | Viscosity Modifier (wt %) | Sulfated Ash (wt %) | Ashless Antioxidant (wt %) |
|---|---|---|---|---|---|---|---|---|
| 1 | 2,200 | 635 | 0.2 | 0.06 | 1, 4 or 5 | b | 0.9 | c |
| 2 | 1,600 | 635 | 0.23 | 0.06 | 2, 3 or 5 | b | 0.7 | c |
| 3 | 1,000 | 635 | 0.26 | 0.06 | 2, 3 or 5 | b | 0.5 | c |
| 4 | 0 | 425 | 0.3 | 0.04 | 1, 2 or 4 | b | 0.1 | c |
| 5 | 1,800 | 1,200 | 0.21 | 0.11 | 1 or 4 | b | 0.9 | c |

Top-up-oil

| Example | Ca (ppm) | Zn (ppm) | N (wt %) | P (wt %) | Viscosity Modifier (wt %) | Sulfated Ash (wt %) | Ashless Antioxidant (wt %) |
|---|---|---|---|---|---|---|---|
| 1 | 0 | 635 | 0.35 | 0.06 | d | 0.2 | e |
| 2 | 1,800 | 1,200 | 0.21 | 0.11 | d | 0.9 | e |
| 3 | 0 | 635 | 0.4 | 0.06 | d | 0.2 | e |
| 4 | 0 | 425 | 0.3 | 0.04 | d | 0.1 | e |

[a] = Anti-oxidants include $Mo_4S_4(C_8H_{17}OCS_2)_6$, Mo Phosphate, $MoS_2$ &NaOH, among others. See U.S. Pat. No. 4,997546 for limited examples.
b = As needed to meet viscosity targets.
c, e = As needed to meet anti-oxidation targets, typically about 0.5–2.0 weight percent.
d = 1 to 3 times the concentration in the lubricant, less if a shear stable viscosity modifier is used, more if a high molecular weight viscosity modifier is used.

1. Lubricant examples 1 through 5 and top-up-oil examples 1 through 4 are designed to reduce piston deposits to current and future engines, to maintain TBN for an extended oil drain interval, and to reduce catalyst poisoning and DPF plugging for those engines with emission after-treatment devices.

2. Top-up-oil examples 2 & 4 have the same formulation as lubricant examples 5 & 4.

3. In general the top-up-oil may have the same or different formulation as the lubricant.

4. A comparison of lubricant example 4 to example 5 shows that removal of the detergent allows a reduction of phosphorus by 64%.

System 4

A Lubrication System Comprising a Chemical Filter Designed for Use with Gasoline Fueled Vehicles A lubricant system designed to maintain an adequate TBN in the used lubricant over an extended oil drain and to reduce piston deposits (which in part are derived from the ash in detergents) comprises a chemical filter, a lubricant and a top-up-oil equal to or different from the lubricant.

The chemical filter portion contains from about 100 to about 1,000 grams of a strong base, from about 0 to about 400 grams of a solubility controlled release rate anti-wear additive and from about 0 to about 200 grams of an immobilized anti-oxidant.

The lubricant portion contains a metal based detergent level giving rise to a sulfated ash content ranging from about 0.1 to about 0.8 weight percent, a P content ranging from about 0.04 to about 0.08 weight percent, and other additives known to those skilled in the art as being necessary to formulate a well balanced lubricant.

The top-up-oil portion contains a detergent level giving rise to a sulfated ash content ranging from 0 to 0.4 weight percent, a P content ranging from about 0.04 to about 0.08 weight percent, a level of dispersant from equal to 3 times the level of dispersant in the lubricant, and other additives known by those skilled in the art to be necessary for the proper functioning of the lubricant. This system is described in the following examples:

Chemical Filter

| Example | MgO (gms) | Controlled Release ZnDDP (gms) | Antioxidant[a] (gms) |
|---|---|---|---|
| 1 | 100 | 0 | 0 |
| 2 | 400 | 0 | 0 |
| 3 | 1,000 | 0 | 0 |
| 4 | 950 | 50 | 0 |
| 5 | 800 | 200 | 0 |
| 6 | 100 | 400 | 0 |
| 7 | 900 | 0 | 100 |
| 8 | 600 | 200 | 200 |
| 9 | 100 | 200 | 200 |

Lubricant

| Example | Ca (ppm) | Zn (ppm) | N (wt %) | P (wt %) | Chemical Filter | Viscosity Modifier (wt %) | Sulfated Ash (wt %) | Ashless Antioxidant (wt %) |
|---|---|---|---|---|---|---|---|---|
| 1[b] | 2,502 | 821 | 0.12 | 0.07 | 2, 3, 4 or 7 | d | 1 | e |
| 2[b] | 1,873 | 873 | 0.115 | 0.08 | 1–4 or 7 | d | 0.82 | e |
| 3[c] | 1,130 | 873 | 0.2 | 0.08 | 1–4 or 7 | d | 0.56 | e |
| 4[c] | 0 | 460 | 0.3 | 0.04 | 3–6 or 7–8 | d | 0.11 | e |
| 5[c] | 0 | 570 | 0.3 | 0.05 | 3–5 or 7–9 | d | 0.12 | e |
| 6[c] | 0 | 460 | 0.3 | 0.04 | 3–5 or 7–9 | d | 0.11 | e |

Top-up-oil

| Example | Ca (ppm) | Zn (ppm) | N (wt %) | P (wt %) | Viscosity Modifier (wt %) | Sulfated Ash (wt %) | Ashless Antioxidant (wt %) |
|---|---|---|---|---|---|---|---|
| 1 | 1,130 | 873 | 0.3 | 0.08 | f | 0.56 | g |
| 2 | 0 | 460 | 0.4 | 0.04 | f | 0.11 g | g |
| 3 | 0 | 570 | 0.4 | 0.05 | f | 0.12 | g |

a = Anti-oxidants include $Mo_4S_4(C_8H_{17}OCS_2)_6$, Mo Phosphate, $MoS_2$ &NaOH, among others. See U.S. Pat. No. 4,997,546 for limited examples.
b = Measured results on currently available commercial lubricants.
c = Ca, Zn, P and N results represent embodiments of this invention. Weight percent sulfated ash are calculated assuming Ca as $CaSO_4$ and Zn as $ZnSO_4$.
d = As needed to meet viscosity targets.
e, g = As needed to meet anti-oxidation targets, typically about 0.5–2.0 weight percent.
f = 1 to 3 times the concentration in the lubricant, less if a shear stable viscosity modifier is used and more if a high molecular weight viscosity modifier is used.

1. The top-up-oil may have the same or a different formulation as the lubricant.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed:

1. An internal combustion engine lubrication system adapted to produce low levels of lubricant additive combustion by-products, comprising:

filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as lubricant passes through the filtration media without adding to at least one of sulfated ash, phosphorus, and sulfur (SAPS) levels of the lubricant; and a lubricant having SAPS levels at least 10% below maximum SAPS levels allowed for an unused lubricant formulated for use in said internal combustion engine lubrication system without said filtration media.

2. The lubrication system of claim 1, wherein the filtration media further comprises an anti-oxidant, an organic acid neutralizing agent, or a combination thereof.

3. The lubrication system of claim 2, wherein the anti-oxidant comprises a hydroperoxide decomposition agent, a radical scavenger, or a combination thereof.

4. The lubrication system of claim 2, wherein the anti-oxidant comprises MoS compounds, $MoS_2$ compounds, $Mo_4S_4$ $(C_8H_{17}OCS_2)_6$ compounds, hindered phenols, aromatic amines, divalent sulfur, disulfides, phosphates, trivalent phosphorus, phosphates, hydroquinones, dihydroquinolines, metal deactivators, or NaOH, or a combination thereof.

5. The lubrication system of claim 1, wherein at least one of the SAPS levels is reduced by at least 10% and as much as 90% below the maximum SAPS levels allowed for the unused lubricant.

6. The lubrication system of claim 1, wherein the filtration media is disposed in a chemical filter.

7. The lubrication system of claim 1, wherein the strong base material comprises magnesium oxide, zinc oxide, or a combination thereof.

8. An internal combustion engine lubrication system adapted to produce low levels of lubricant additive combustion by-products, wherein the lubrication system experiences a loss of a volume of lubricant over time during the ordinary course of operation of the combustion engine, comprising:

filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as lubricant passes through the filtration media without adding to at least one of sulfated ash, phosphorus, and sulfur (SAPS) levels of the lubricant; and a lubricant having SAPS levels at least 10% below maximum SAPS levels allowed for an unused lubricant formulated for use in said internal combustion engine lubrication system without said filtration media; and a top-up-oil of a volume approximately equal to the volume of lubricant lost during operation of the combustion engine, wherein the top-up-oil has substantially elevated amounts of at least one lubricant additive.

9. The lubrication system of claim 8, wherein at least one of the SAPS levels is reduced by at least 10% and as much as 90% below the maximum SAPS levels allowed for the unused lubricant.

10. The lubrication system of claim 8, wherein the filtration media is disposed in a chemical filter.

11. The lubrication system of claim 8, wherein the filtration media further comprises an anti-oxidant, an organic acid neutralizing agent, or a combination thereof.

12. The lubrication system of claim 8, wherein the top-up-oil comprises an oil having substantially reduced levels of detergent.

13. The lubrication system of claim 8, wherein the substantially elevated amounts of at least one lubricant additive of the top-up-oil comprises elevated amounts of viscosity modifier dispersant, anti-wear agent, anti-oxidant, or a combination thereof.

14. An internal combustion engine lubrication system adapted to produce low levels of lubricant additive combustion by-products, comprising:

a lubricant having reduced levels of a lubricant additive relative to a level of the lubricant additive in an unused lubricant formulated to have a maximum sulfated ash, phosphorus, and sulfur (SAPS) level allowed for use in said internal combustion engine lubrication system; and filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as lubricant passes through the filtration media without adding to the SAPS levels of the lubricant.

15. The lubrication system of claim 14, wherein the filtration media further comprises an anti-oxidant or a combination of said strong base material with said anti-oxidant.

16. The lubrication system of claim 15, wherein the anti-oxidant comprises a hydroperoxide decomposition agent, a radical scavenger, or a combination thereof.

17. The lubrication system of claim 15, wherein the anti-oxidant comprises MoS compounds, $MoS_2$ compounds, $Mo_4S_4$ $(C_8H_{17}OCS_2)_6$ compounds, hindered phenols, aromatic amines, divalent sulfur, disulfides, phosphates, trivalent phosphorus, phosphates, hydroquinones, dihydroquinolines, metal deactivators, or NaOH, or a combination thereof.

18. The lubrication system of claim 14, wherein at least one of the SAPS levels is reduced by at least 10% and as much as 70% below the maximum SAPS levels allowed for the unused lubricant without said filtration media.

19. The lubrication system of claim 14, wherein the strong base material comprises magnesium oxide, zinc oxide, or a combination thereof.

20. An internal combustion engine lubrication system adapted to produce low levels of lubricant additive combustion by-products, comprising:

a lubricant having lubricant additives that produce a sulfated ash content at or below about 0.9 wt %, and/or a phosphorus content at or below about 0.1 wt %; and filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as the lubricant passes through the filtration media without adding to the sulfated ash content or the phosphorus content of the lubricant.

21. The lubrication system of claim 20, wherein the lubricant comprises lubricant additives that produce a sulfated ash content at or below about 0.5 wt % and/or a phosphorus content at or below about 0.06 wt %.

22. The lubrication system of claim 20, wherein the lubricant comprises lubricant additives that produce a sulfated ash content at or below about 0.3 wt % and/or a phosphorus content at or below about 0.04 wt %.

23. A lubrication system for a diesel fueled internal combustion engine, the lubrication system adapted to produce low levels of lubricant additive combustion by-products, comprising:

filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as lubricant passes through the filtration media without adding to at least one of sulfated ash, phosphorus, and sulfur (SAPS) levels of the lubricant; and a lubricant having SAPS levels at least 10% below maximum SAPS levels allowed for an unused lubricant formulated for use in said internal combustion engine lubrication system without said filtration media.

24. The lubrication system of claim 23, wherein the lubricant contains less than or equal to 1.1 weight percent sulfated ash content.

25. The lubrication system of claim 23, wherein the lubricant contains less than or equal to 3660 parts per million of sulfur.

26. The lubrication system of claim 23, wherein the lubricant contains less than or equal to 1050 parts per million of phosphorus.

27. A lubrication system for a gasoline fueled internal combustion engine, the lubrication system adapted to produce low levels of lubricant additive combustion by-products, comprising:

filtration media including particles having internal pores formed within individual particles and interstitial pores formed between adjacent particles, the internal pores and the interstitial pores collectively defining filtration media pores, and a strong base material associated with at least some of the internal pores, wherein the filtration media pores have a surface area greater than or equal to 25 $m^2$/gm that is derived from filtration media pores that are large enough to receive a combustion acid-dispersant weak base complex contained within oil flowing through the filtration media, the filtration media sequestering acids and/or neutralized acids as lubricant passes through the filtration media without adding to at least one of sulfated ash, phosphorus, and sulfur (SAPS) levels of the lubricant; and a lubricant having SAPS levels at least 10% below maximum SAPS levels allowed for an unused lubricant formulated for use in said internal combustion engine lubrication system without said filtration media.

28. The lubrication system of claim 27, wherein the lubricant contains less than or equal to 0.7 weight percent sulfated ash content.

29. The lubrication system of claim 27, wherein the lubricant is a 10W multi-grade lubricant containing less than or equal to 0.6 weight percent sulfur.

30. The lubrication system of claim 27, wherein the lubricant is a 0W-XX or 5W-XX grade lubricant containing less than or equal to 0.45 weight percent sulfur.

31. The lubrication system of claim 27, wherein the lubricant contains less than or equal to 0.7 weight percent phosphorus.

* * * * *